US008776445B1

(12) United States Patent
Jhaveri et al.

(10) Patent No.: US 8,776,445 B1
(45) **Date of Patent: *Jul. 15, 2014**

(54) PHARMACY WORKSPACE

(75) Inventors: Nimesh S. Jhaveri, Kildeer, IL (US); Archana Dhruve, Bartlett, IL (US); Heather K. Hill, Barrington, IL (US); Dejan Kozic, Wadsworth, IL (US); Laura Jean Tebbe, Antioch, IL (US); Susan G. Heald, Buffalo Grove, IL (US); Warit Tulyathorn, Chicago, IL (US); Mark A. Jones, Evanston, IL (US); Sara B. Frisk, Chicago, IL (US); Jennifer M. Levin, Chicago, IL (US); Jennifer A. Comiskey, Chicago, IL (US); David T. Blanchard, Evanston, IL (US)

(73) Assignee: Walgreen Co., Deerfield, IL (US)

( * ) Notice: Subject to any disclaimer, the term of this patent is extended or adjusted under 35 U.S.C. 154(b) by 295 days.

This patent is subject to a terminal disclaimer.

(21) Appl. No.: 13/286,922

(22) Filed: Nov. 1, 2011

Related U.S. Application Data

(60) Provisional application No. 61/408,968, filed on Nov. 1, 2010.

(51) Int. Cl.
*E04H 3/08* (2006.01)
*E04H 14/00* (2006.01)

(52) U.S. Cl.
USPC ..... 52/33; 52/36.1; 52/79.1; 52/79.8; 52/173.1; 52/234; 186/35; 186/36; 705/2

(58) Field of Classification Search
CPC ..... E04H 3/08; E04H 14/00
USPC ..... 52/36.1, 36.4, 79.1, 79.7, 79.8, 234, 52/238.1, 33, 79.6, 173.1, 174, 236.1; 186/35, 36; 705/2
See application file for complete search history.

(56) References Cited

U.S. PATENT DOCUMENTS

| | | | | | |
|---|---|---|---|---|---|
| 1,348,024 | A | * | 7/1920 | McCarty | 52/33 |
| 1,372,095 | A | * | 3/1921 | Shaul | 52/65 |
| 1,404,613 | A | * | 1/1922 | Hormes | 434/72 |
| RE15,368 | E | * | 5/1922 | McCarty | 52/33 |

(Continued)

FOREIGN PATENT DOCUMENTS

| | | | |
|---|---|---|---|
| DE | 102004026338 | * | 12/2005 |
| EP | 1547491 A1 | * | 6/2005 |

(Continued)

OTHER PUBLICATIONS

Thrifty debuts new prototype. (Thrifty Drug Stores Inc.), Chain Store Age Executive with Shopping Center Age, v69, n2, p. 30(1), Feb. 1993 (2 pages).*

*Primary Examiner* — Basil Katcheves
*Assistant Examiner* — Rodney Mintz
(74) *Attorney, Agent, or Firm* — Francis C. Kowalik; Marshall, Gerstein & Borun LLP; Randall G. Rueth

(57) ABSTRACT

A pharmacy workspace that has a prescription station that has a prescription desk; a pharmacist station that has a pharmacist desk that is distinct from the prescription desk; a clinic station that has an examination room; and a reception desk that is centrally positioned between the three stations and separated from them by only an open circulation area.

18 Claims, 24 Drawing Sheets

(56) References Cited

U.S. PATENT DOCUMENTS

RE17,178 E * 1/1929 Trapp ..... 52/33
1,717,123 A * 6/1929 Sharp ..... 52/31
1,766,409 A * 6/1930 Stocks ..... 312/42
1,780,102 A * 10/1930 Watt ..... 52/200
1,873,852 A * 8/1932 Rorrer et al. ..... 52/33
2,154,897 A * 4/1939 Grant ..... 52/79.4
2,285,962 A * 6/1942 Foulkes ..... 52/29
2,756,584 A * 7/1956 Shelton ..... 52/236.1
2,823,425 A * 2/1958 Granek ..... 52/65
3,346,997 A * 10/1967 Parrish ..... 52/34
3,437,057 A * 4/1969 Wulff ..... 108/22
3,451,261 A * 6/1969 Olsen ..... 73/116.01
3,470,871 A * 10/1969 Shoen ..... 600/301
3,606,045 A * 9/1971 Abromavage et al. ..... 414/564
3,623,283 A * 11/1971 Abromavage et al. ..... 52/19
3,638,641 A * 2/1972 Abromavage et al. ..... 600/301
3,696,805 A * 10/1972 Sweeten et al. ..... 600/301
3,732,649 A * 5/1973 Mehran ..... 52/169.3
3,742,932 A * 7/1973 Greenspan ..... 600/21
3,778,911 A * 12/1973 Woolman ..... 434/432
3,789,560 A * 2/1974 Wood ..... 52/236.1
3,862,525 A * 1/1975 Greenspan ..... 52/64
3,879,913 A * 4/1975 Clark ..... 52/741.1
3,897,855 A * 8/1975 Patterson ..... 312/209
3,911,900 A * 10/1975 Shoen et al. ..... 600/301
3,922,788 A * 12/1975 Rota ..... 433/33
4,074,793 A * 2/1978 Yuter ..... 186/38
4,095,379 A * 6/1978 Weintraub ..... 52/29
4,116,509 A * 9/1978 Smith ..... 312/107
4,154,027 A * 5/1979 Searcy ..... 52/33
4,259,816 A * 4/1981 Bergquist ..... 52/33
4,274,233 A * 6/1981 Currier ..... 52/33
D260,709 S * 9/1981 Perlmutter ..... D6/470
4,288,948 A * 9/1981 Harris ..... 52/28
D262,926 S * 2/1982 Woolford ..... D6/471
4,359,843 A * 11/1982 Schachar ..... 52/29
4,663,895 A * 5/1987 Brice ..... 52/33
4,821,469 A * 4/1989 Bayless ..... 52/33
4,823,523 A * 4/1989 Coupard et al. ..... 52/3
4,841,692 A * 6/1989 Coupard et al. ..... 52/3
5,039,616 A * 8/1991 Copelan ..... 436/56
5,133,935 A * 7/1992 Copelan ..... 422/430
5,193,648 A * 3/1993 Yuter ..... 186/38
5,355,395 A * 10/1994 Kenneth et al. ..... 376/216
5,511,594 A * 4/1996 Brennan et al. ..... 141/98
5,597,995 A * 1/1997 Williams et al. ..... 235/375
5,622,010 A * 4/1997 Weber ..... 52/36.4
D386,327 S * 11/1997 Rotchin ..... D6/470
5,775,033 A * 7/1998 Meehan ..... 52/33
5,782,045 A * 7/1998 Paschal ..... 52/220.8
5,806,260 A * 9/1998 Quaintance ..... 52/236.3
5,809,708 A * 9/1998 Greer et al. ..... 52/220.7
5,878,535 A * 3/1999 Green ..... 52/33
6,082,799 A * 7/2000 Marek ..... 296/24.38
6,141,924 A * 11/2000 Quaintance ..... 52/236.3
6,179,358 B1 * 1/2001 Hirayama et al. ..... 296/24.38
6,196,648 B1 * 3/2001 Henriott ..... 312/196
6,205,716 B1 * 3/2001 Peltz ..... 52/36.2
6,243,993 B1 * 6/2001 Swensson ..... 52/79.5
6,256,936 B1 * 7/2001 Swensson et al. ..... 52/35
6,360,494 B1 * 3/2002 Emerson ..... 52/106
6,415,555 B1 * 7/2002 Montague ..... 52/36.2
6,588,548 B1 * 7/2003 Dewitt ..... 186/2
6,748,704 B2 * 6/2004 Eguchi et al. ..... 52/79.1
6,944,996 B1 * 9/2005 Rowe ..... 52/236.1
6,970,144 B1 * 11/2005 Swift et al. ..... 345/1.1
7,083,515 B2 * 8/2006 Rapisarda et al. ..... 454/187
7,143,050 B2 * 11/2006 Crane ..... 705/2
7,174,678 B2 * 2/2007 Gallant ..... 52/36.1
7,269,925 B2 * 9/2007 Lam ..... 52/79.1
D553,128 S * 10/2007 Murphy ..... D14/305
7,320,200 B1 * 1/2008 Eisner ..... 52/236.1
7,454,868 B2 * 11/2008 Clark ..... 52/243.1
7,537,030 B2 * 5/2009 Gallant ..... 141/18
7,540,546 B2 * 6/2009 Kern et al. ..... 296/19
7,653,557 B2 * 1/2010 Sweetser ..... 705/3
7,860,724 B2 * 12/2010 Chudy et al. ..... 705/2
7,985,382 B1 * 7/2011 Henry et al. ..... 422/291
7,992,355 B2 * 8/2011 Bridgman et al. ..... 52/174
8,006,804 B2 * 8/2011 Coleman et al. ..... 186/38
8,069,618 B2 * 12/2011 Larsson ..... 52/79.8
8,087,202 B2 * 1/2012 Ciavolella ..... 52/106
8,097,451 B2 * 1/2012 Gaalswyk ..... 435/289.1
8,112,942 B2 * 2/2012 Bohm et al. ..... 52/79.1
8,215,065 B2 * 7/2012 Gallant ..... 52/36.1
8,341,899 B2 * 1/2013 Solomon et al. ..... 52/234
8,352,176 B2 * 1/2013 Kaldewey et al. ..... 701/409
8,402,699 B2 * 3/2013 Henriott ..... 52/36.1
8,474,203 B1 * 7/2013 Stewart et al. ..... 52/236.3
D687,644 S * 8/2013 Jhaveri et al. ..... D6/686
8,533,927 B2 * 9/2013 Atherton et al. ..... 29/464
8,555,578 B2 * 10/2013 Hushek ..... 52/238.1
8,571,886 B2 * 10/2013 Chudy et al. ..... 705/2
8,584,349 B2 * 11/2013 Scannon et al. ..... 29/722
8,590,186 B2 * 11/2013 Puello ..... 40/606.17
8,621,786 B2 * 1/2014 Lam ..... 52/33
8,656,670 B2 * 2/2014 Mouzannar ..... 52/234
8,671,633 B2 * 3/2014 Haab et al. ..... 52/243.1
8,689,493 B2 * 4/2014 Alarcon et al. ..... 52/36.1
8,707,630 B1 * 4/2014 Jhaveri et al. ..... 52/36.1
8,707,633 B2 * 4/2014 Han et al. ..... 52/79.5
2002/0046518 A1 * 4/2002 Eguchi et al. ..... 52/220.1
2002/0108334 A1 * 8/2002 Rapisarda et al. ..... 52/302.1
2002/0138367 A1 * 9/2002 Meurer ..... 705/27
2003/0019165 A1 * 1/2003 Gallant et al. ..... 52/36.4
2003/0131545 A1 * 7/2003 Kishimoto ..... 52/174
2003/0136066 A1 * 7/2003 Kishimoto et al. ..... 52/239
2003/0177721 A1 * 9/2003 Wong ..... 52/234
2003/0195768 A1 * 10/2003 Taylor ..... 705/2
2003/0213184 A1 * 11/2003 Hunt et al. ..... 52/36.1
2004/0088187 A1 * 5/2004 Chudy et al. ..... 705/2
2004/0111290 A1 * 6/2004 Crane ..... 705/2
2004/0111295 A1 * 6/2004 Crane ..... 705/2
2004/0159051 A1 * 8/2004 Lam ..... 52/79.1
2004/0172887 A1 * 9/2004 Moglin et al. ..... 52/36.1
2004/0186744 A1 * 9/2004 Lux ..... 705/2
2005/0008829 A1 * 1/2005 Suits ..... 428/195.1
2005/0138867 A1 * 6/2005 Zhao ..... 52/79.1
2005/0273343 A1 * 12/2005 Coleman et al. ..... 705/1
2005/0277872 A1 * 12/2005 Colby et al. ..... 604/67
2005/0279035 A1 * 12/2005 Donovan ..... 52/79.1
2005/0288571 A1 * 12/2005 Perkins et al. ..... 600/407
2006/0004605 A1 * 1/2006 Donoghue et al. ..... 705/2
2006/0143997 A1 * 7/2006 Libenson ..... 52/234
2007/0000185 A1 * 1/2007 DeLine ..... 52/33
2007/0039253 A1 * 2/2007 Snowden ..... 52/79.1
2007/0074471 A1 * 4/2007 Gallagher ..... 52/236.3
2007/0125008 A1 * 6/2007 Gallant ..... 52/36.4
2007/0204527 A1 * 9/2007 Clark ..... 52/79.1
2007/0252003 A1 * 11/2007 Goldring et al. ..... 235/381
2007/0260473 A1 * 11/2007 Cornacchia ..... 705/1
2008/0012936 A1 * 1/2008 White ..... 348/14.16
2008/0098666 A1 * 5/2008 Larsson ..... 52/79.11
2008/0127574 A1 * 6/2008 Yi ..... 52/8
2008/0173779 A1 * 7/2008 Beno et al. ..... 248/309.1
2008/0221919 A1 * 9/2008 Cates ..... 705/2
2008/0313973 A1 * 12/2008 Butler Rolf ..... 52/79.1
2009/0025321 A1 * 1/2009 Cherney et al. ..... 52/238.1
2009/0126285 A1 * 5/2009 Suh et al. ..... 52/79.1
2009/0210359 A1 * 8/2009 Chapman ..... 705/500
2009/0249708 A1 * 10/2009 Zschornack et al. ..... 52/79.9
2009/0255195 A1 * 10/2009 Bridgman et al. ..... 52/174
2009/0292465 A1 * 11/2009 Kaldewey et al. ..... 701/209
2010/0013812 A1 * 1/2010 Gu et al. ..... 345/207
2010/0238265 A1 * 9/2010 White ..... 348/14.16
2010/0324380 A1 * 12/2010 Perkins et al. ..... 600/301
2011/0041434 A1 * 2/2011 Solomon et al. ..... 52/234
2011/0053486 A1 * 3/2011 Holtz et al. ..... 454/187
2011/0120035 A1 * 5/2011 Staebler ..... 52/234
2011/0173898 A1 * 7/2011 Denicourt et al. ..... 52/79.1
2011/0191269 A1 * 8/2011 Weis et al. ..... 705/500
2011/0209415 A1 * 9/2011 Lowes et al. ..... 52/1
2012/0110935 A1 * 5/2012 Pinkas ..... 52/234
2012/0229592 A1 * 9/2012 White ..... 348/14.08

(56) References Cited

U.S. PATENT DOCUMENTS

| | | | | |
|---|---|---|---|---|
| 2013/0025221 | A1* | 1/2013 | Mouzannar | 52/234 |
| 2013/0111825 | A1* | 5/2013 | Lefkus et al. | 52/79.1 |
| 2013/0192153 | A1* | 8/2013 | Kobe et al. | 52/234 |
| 2013/0219807 | A1* | 8/2013 | Elliott et al. | 52/79.1 |
| 2014/0083024 | A1* | 3/2014 | Koppelman et al. | 52/79.5 |
| 2014/0090801 | A1* | 4/2014 | McCahill | 165/49 |
| 2014/0095190 | A1* | 4/2014 | Chudy et al. | 705/2 |
| 2014/0096461 | A1* | 4/2014 | McLoughlin et al. | 52/173.1 |
| 2014/0115986 | * | 5/2014 | Lam | 52/236.3 |

FOREIGN PATENT DOCUMENTS

| | | | |
|---|---|---|---|
| EP | 1748126 | A1 * | 1/2007 |
| EP | 2273400 | A1 * | 1/2011 |
| WO | WO 2006061402 | A1 * | 6/2006 |
| WO | WO 2012134556 | A1 * | 10/2012 |

* cited by examiner

Walgreens rapid refill rapid refill: the faster way to pharmacy

Refill Your Rx Online or by Phone.

Pick it Up Here.

Just swipe your card to check in.

Don't have a card?

Enter your phone number.

*FIG. 19*

Walgreens community corner

June 20, 2010

| | SUN | MON | TUE | WED | THU | FRI | SAT |
|---|---|---|---|---|---|---|---|
| JUNE | 20<br>**Walgreens Walkers**<br>7:00 p.m.<br>**Smoking Cessation Class**<br>6:00 p.m. | 21 | 22 | 23 | 24<br>**Weight Watchers Group Meeting**<br>Chicago Group 118<br>6:00 p.m. | 25 | 26 |
| | 27 | 28 | 29<br>**Sport Camp Check-ups**<br>11:00 a.m. - 4:30 p.m. | 30 | 1 | 2<br>**American Red Cross Blood Drive**<br>9:00 a.m. - 4:30 p.m. | 3 |
| JULY | 4<br>**Managing Back Pain**<br>3:00 p.m. | 5 | 6 | 7<br>**You Are What You Eat!**<br>5:00 p.m. - 7:00 p.m. | 8 | 9 | 10 |
| | 11 | 12<br>**Caring for Your Newborn**<br>7:00 p.m. | 13 | 14 | 15<br>**Cholesterol Screening**<br>6:30 p.m. | 16<br>**Managing Seasonal Allergies**<br>6:30 p.m. | 17 |

COMING SOON

July 7, 2010

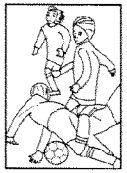

Sport Camp Check-ups

Need text here

11:00 a.m. - 4:30 p.m.
Chicago Y.M.C.A.

For more information or to register for an event, please see our health guide.

*FIG. 22*

PHARMACY WORKSPACE

CROSS-REFERENCE TO RELATED APPLICATIONS

The present application claims the benefit of U.S. Provisional Patent Application No. 61/408,968 filed Nov. 1, 2010, the disclosure of which is incorporated herein by reference in its entirety for all purposes.

BACKGROUND OF THE INVENTION

The present invention relates generally to pharmacy services, and more particularly to a new retail workspace where pharmacy services are provided.

Most consumers are self-reliant about health issues. When people encounter a health issue that requires them to make a decision or take action, they like to turn to a variety of resources and make the decision on their own terms, for example by self-diagnosis and searching not only for the answers provided by traditional medicine, but also for alternatives.

When it comes to health care, consumers prefer to listen to trusted sources. People often look to friends or neutral parties rather than to experts.

Catalysts such as a health crisis or event, an inspiring role model, changes in social milieu, or a trusted source can change attitudes about health care, increasing the belief that action is needed. Reinforcers such as incentives, social support, easy access, and recognition of progress can help drive that action.

It is believed that health care service can be improved by:

relating health care services in to the rhythm of the customer's life;

showing the customer that a range of health services are offered;

offering options for how the customer interacts with the provider; and providing a simplified, light-touch experience.

BRIEF SUMMARY

The applicants have developed a new pharmacy workspace where pharmacy services are provided. Like some known prior known pharmacy workspaces, the new workspace has both a prescription station and a clinic station. The prescription station has a prescription desk, and the clinic station has an examination room. Unlike prior known pharmacy workspaces, the new workspace also has a reception desk that is centrally positioned between the prescription station, the clinic station, and a pharmacist station, and is separated from those three stations by only an open circulation area. This workspace may help to provide the options and the simplified, light-touch light touch experience that can improve the health care experience for customers.

The reception desk can be located twenty-five feet or less from the prescription desk and thirty-five feet or less from the pharmacist desk and from an entrance to the clinic station. The sum of the distances from the reception desk to (a) an entrance to the clinic station, (b) the pharmacist desk, and (c) the prescription desk can be 50 feet or less.

To enable one-on-one communications with a professional, the pharmacist desk may have a front edge that borders the open circulation area, with pharmacist seating behind it where a pharmacist may be stationed. The desk may face the reception desk, providing direct line-of-sight to a display above the reception desk where wait times are displayed. The pharmacist station may be adjacent to and connected to the prescription station.

To provide good flow, the prescription station may have two adjacent and angled prescription desks that border the open circulation area and face the reception desk, giving direct line-of-sight to the same or another display above the reception desk where wait times are displayed. For customer convenience, the prescription station may also have a kiosk that prompts customers to enter identifying information and enables customers to confirm and to pay for a prescription.

The clinic station may have one or more private examination rooms where screenings or immunizations can be provided. The station may be staffed by a medical assistant, and may also have video conference equipment that enables a customer to consult with a health care specialist. It may also have an entrance that also adjoins the open circulation area and faces the reception desk, again providing direct line-of-sight to a display above the reception desk where wait times are displayed. A waiting area may be positioned between the entrance to the clinic station and the examination rooms.

In another aspect of the invention, the workspace has a touchscreen device that can be used by an employee stationed at the reception desk. The touchscreen device may enable the entry of identifying information about a customer; prompt a user to request information about one or more of health topics, community events, and pharmacy programs; and enable a customer to check in for appointments and sign up for events. The touchscreen device uses data associated with a customer (a) to automatically provide third party health recommendations; (b) to steer the customer to the pharmacist station when the pharmacist will have health recommendations for the customer; and (c) to steer the customer to the clinic station when a medical assistant will have health recommendations for the customer.

BRIEF DESCRIPTION OF THE DRAWINGS

The invention may be better understood by referring to the accompanying drawings, in which:

FIG. 19 is a home page screen display on another touchscreen device that can be used in the workspace.

FIG. 22 is an example of a screen display that may be presented on the display seen in FIG. 21.

DETAILED DESCRIPTION

Figure 1:
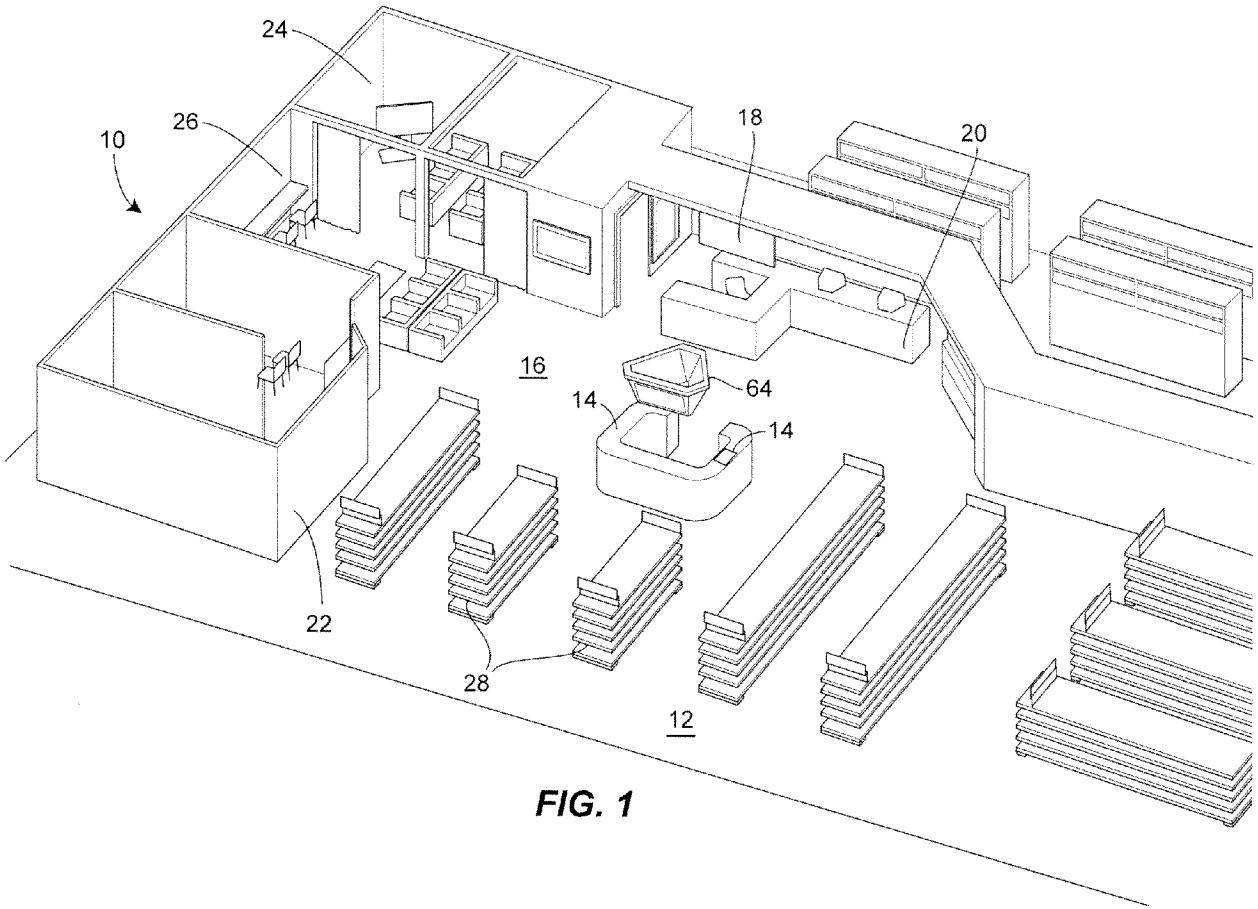
FIG. 1 is a perspective view of one embodiment of the new pharmacy workspace.

The workspace seen in FIG. 1 is one embodiment of a pharmacy workspace 10 that can be used in a drug store or the like to provide pharmacy services to customers. The illustrated workspace has a reception desk 12 with one or more touchscreen devices 14, an open circulation area 16, a pharmacist station 18, a prescription station 20, a clinic station 22, a flexible workspace 24, and a primary patient waiting area 26. Gondolas 28 separate the pharmacy workspace from the rest of the store, and are stocked with goods. Each of these parts of the illustrated workspace will be discussed in turn.

Figure 2:
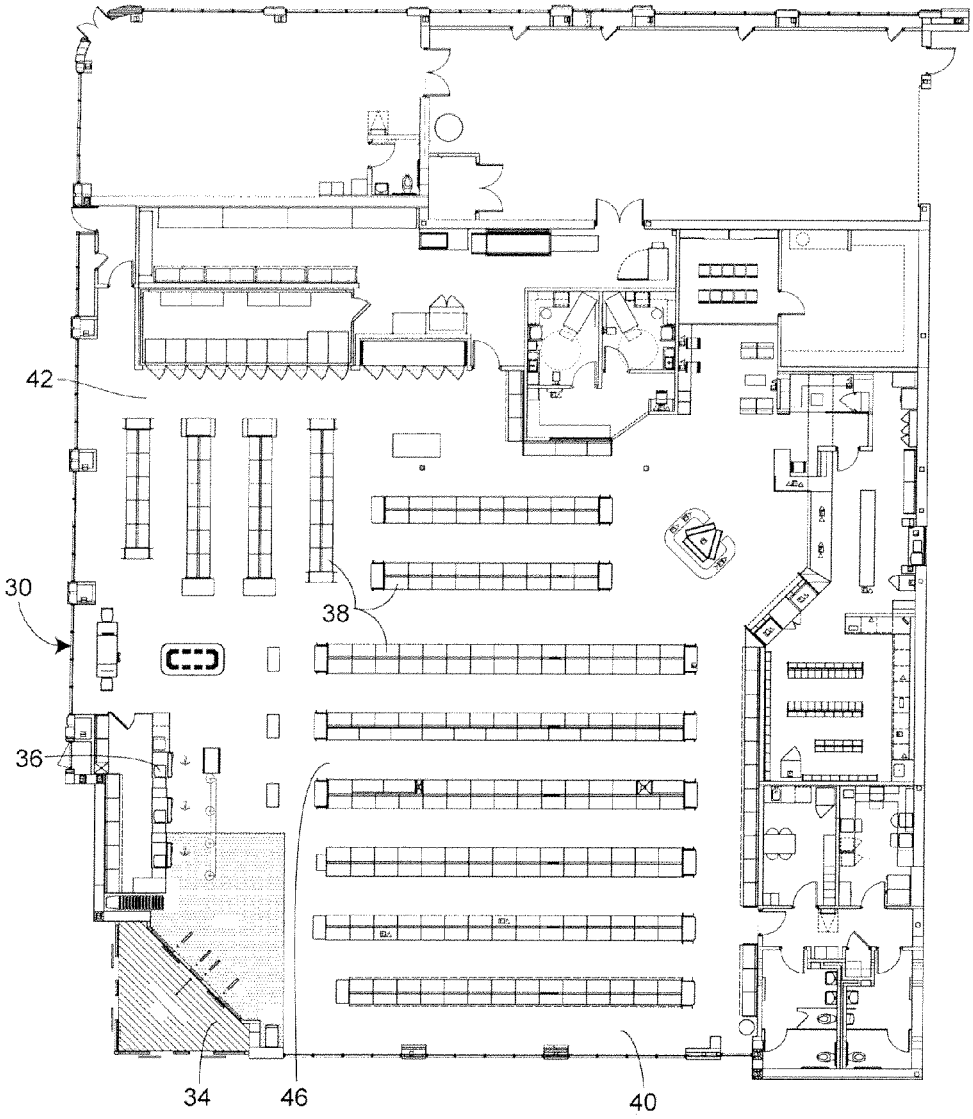
FIGS. 2 and 3 are floor plans of two stores that use embodiments of the new pharmacy workspace.
Figure 3:
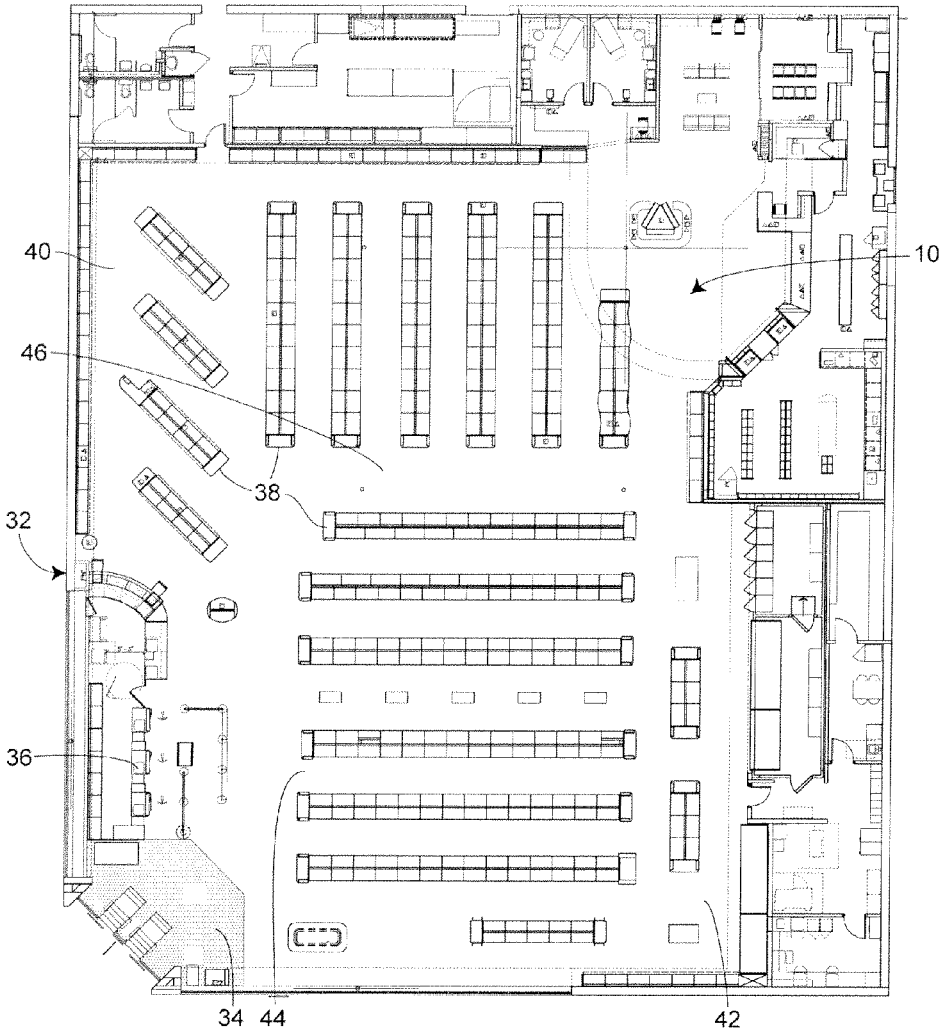

FIGS. 2 and 3 are floor plans of drug stores 30 and 32 that use embodiments of the workspace. The store 30 seen in FIG. 2 is smaller than the one seen in FIG. 3. Each illustrated store has a front corner vestibule 34 where customers enter and exit the store, a row 36 of check-out counters where customers can pay for their purchases, and shelving 38 for merchandise. As is customary in the trade, similar products can be stocked together, for example with beauty products in a beauty section 40, food items in a food section 42, home products in a home section 44 (FIG. 3), and other products in a general section 46. In these examples, the pharmacy workspace 10 is positioned in a back corner of the store. Positioning the pharmacy workspace away from the vestibule gives customers a chance to see a variety of products as they walk through the store to the pharmacy workspace.

The Reception Desk and Touchscreen Devices

The reception desk 12 serves as a welcoming position within the pharmacy workspace 10. It provides the hub of the customer' experience, offering personal and digital resources that will help them discover new services, answer product questions, check-in for services, and sign-up for events.

Figure 4:
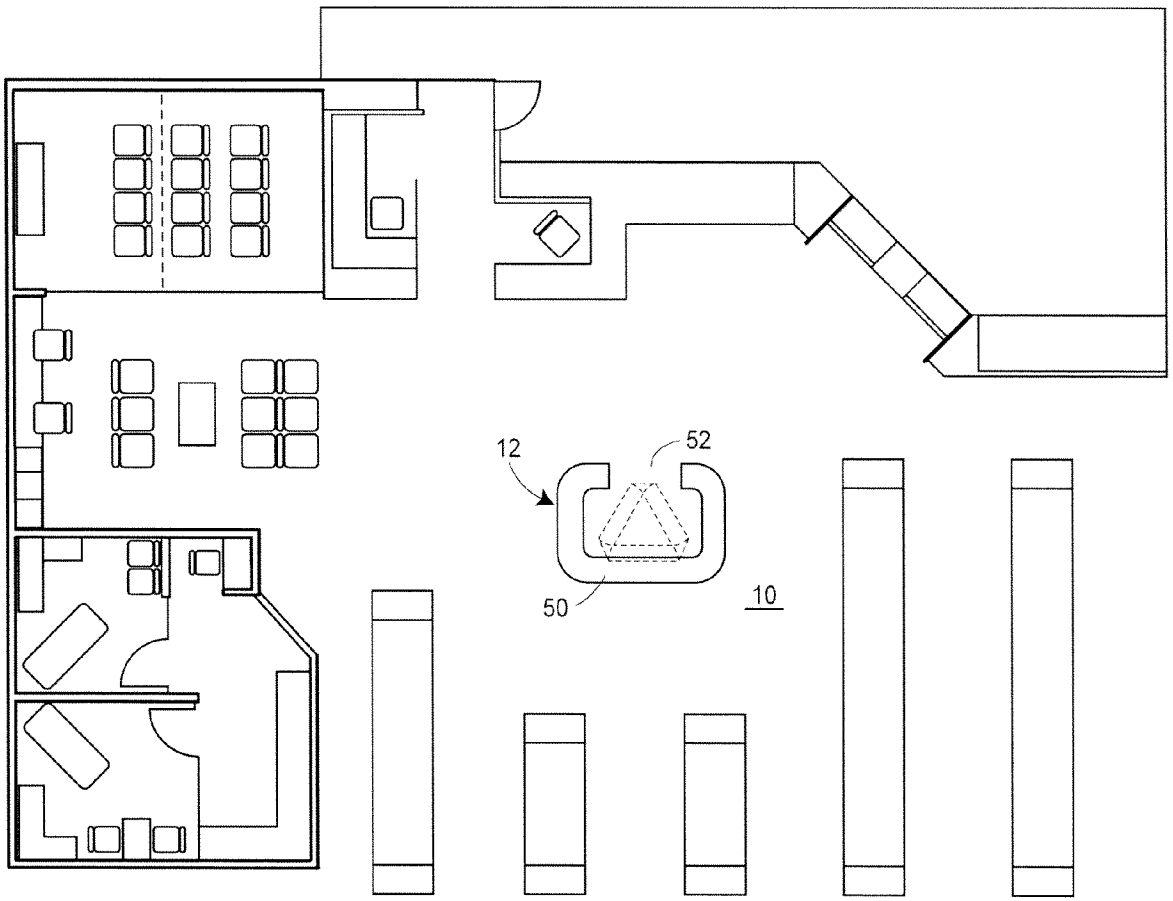
FIGS. 4 and 5 are floor plans of other embodiments of the new pharmacy workspace.
Figure 5:
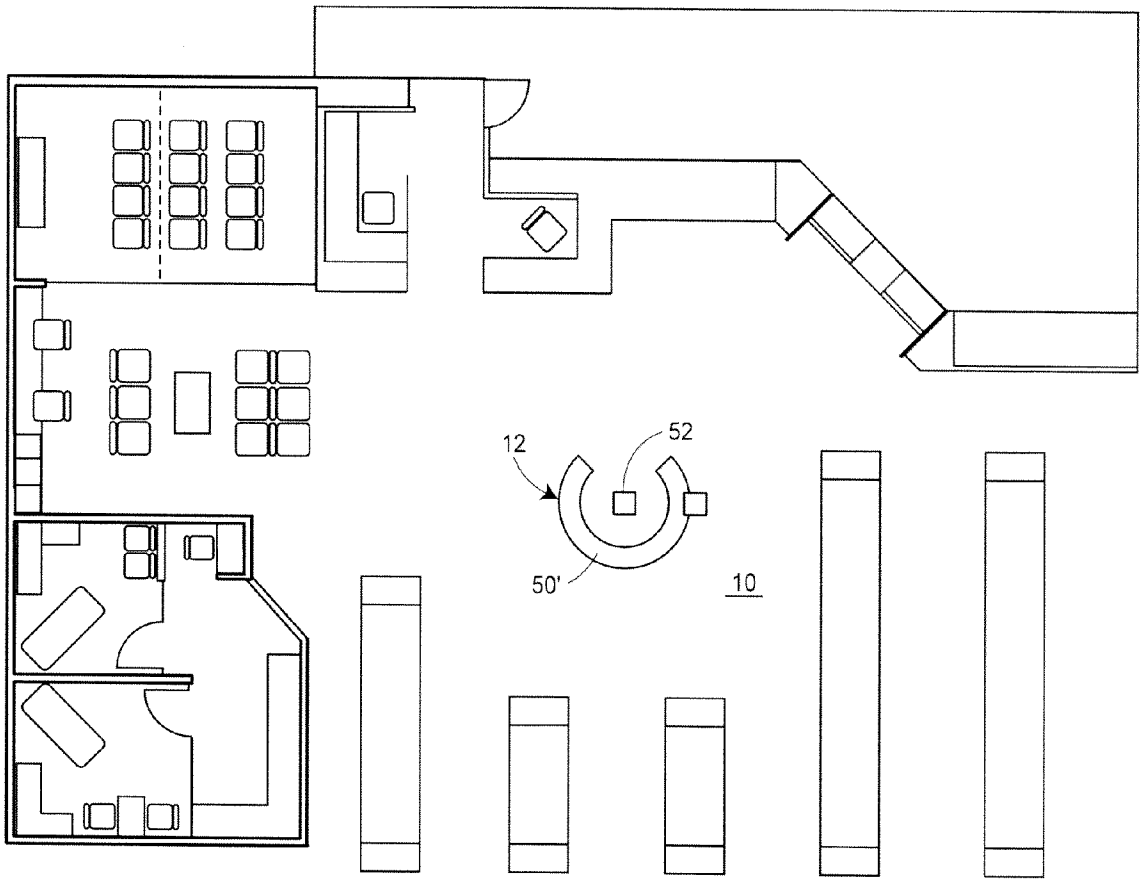

The reception desk 12 is arranged with a desktop 50 that wraps around a central location 52 where an employee "health guide" may be stationed. As seen in FIG. 4, the desktop may be arranged as a block letter "c", as with a straight front surface, two straight sides, and rounded corner sections. In an alternative arrangement, the desktop 50' seen in FIG. 5 is arranged as a rounded letter "c", with the surface spanning an arc of approximately 270 degrees. In both illustrated arrangements, the desktop is between 10" and 28" wide from outer edge to inner edge of the desktop, and covers an area of more than 16 square feet within a 3½ foot radius of the central position at the reception desk.

Figure 6:
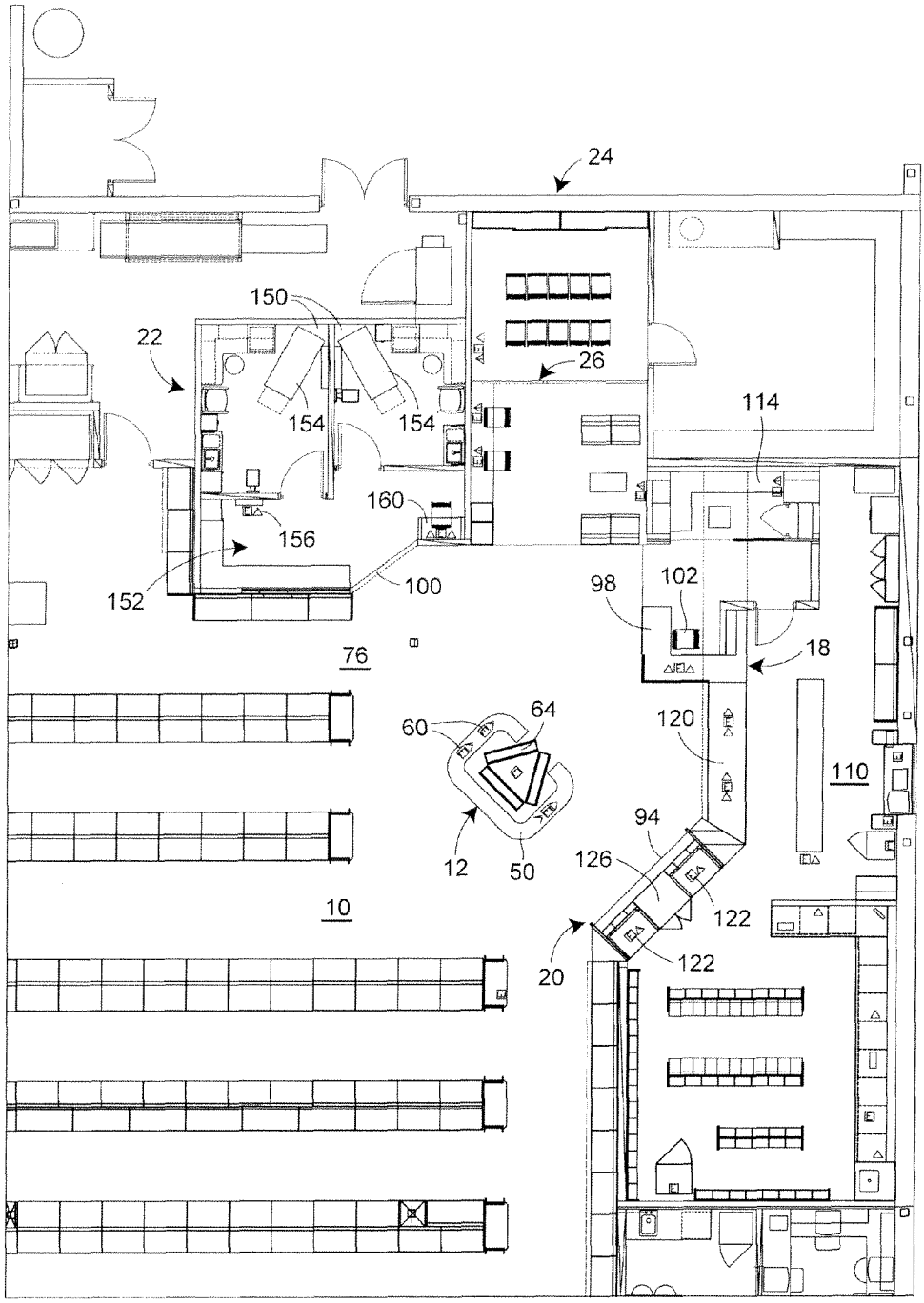
FIGS. 6 and 7 are enlarged fragmentary views of the floor plans seen in FIGS. 2 and 3.
Figure 7:
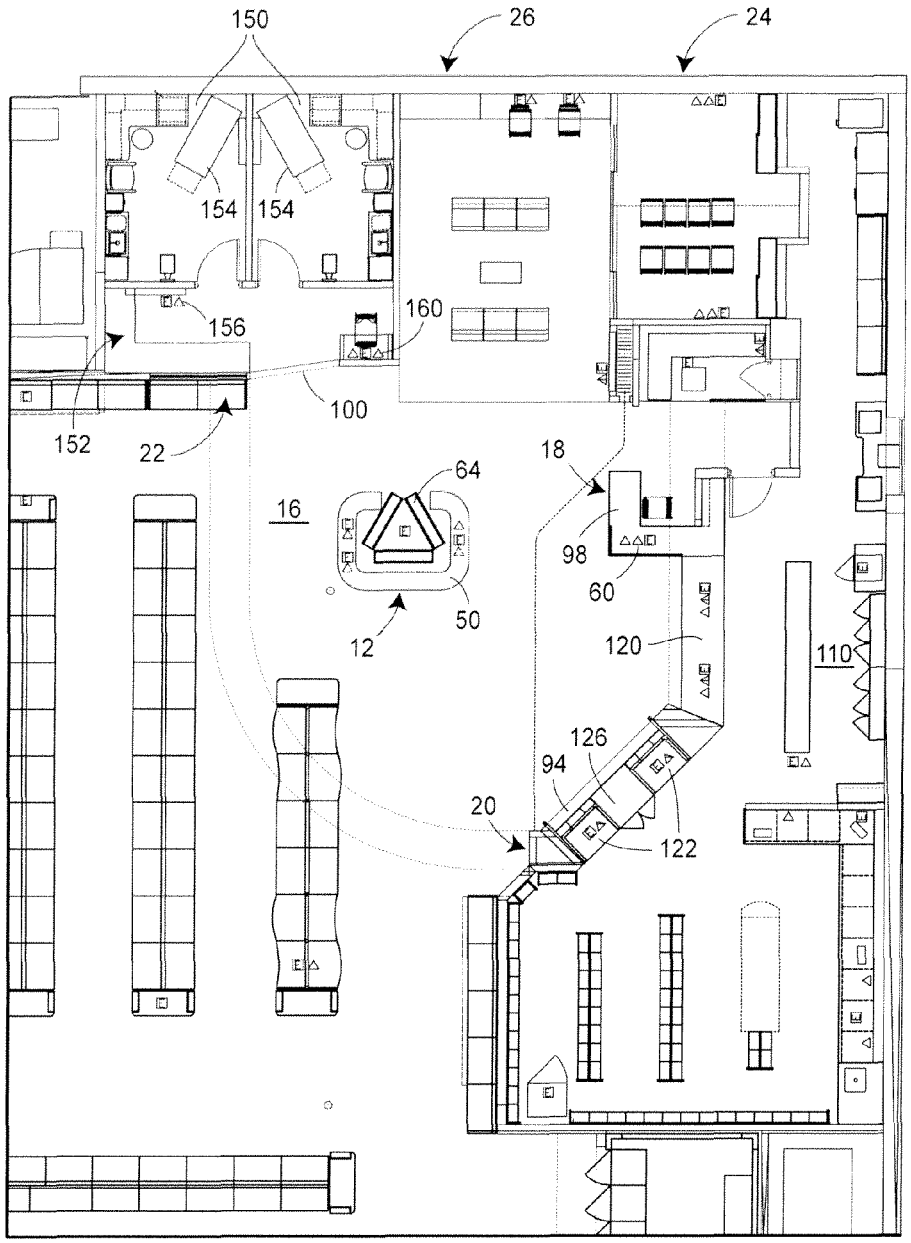
Figure 8:
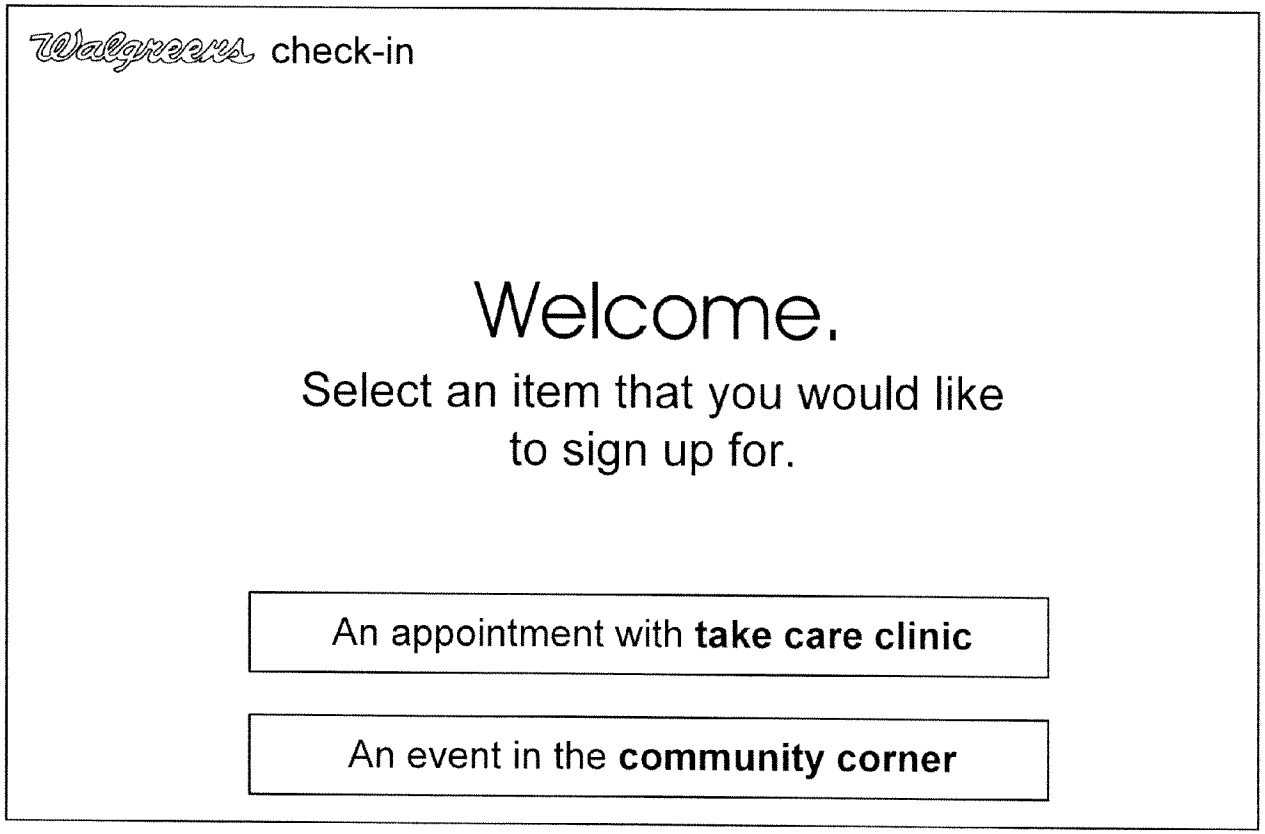
FIG. 8 is a screen display for customer check-ins.
Figure 9:
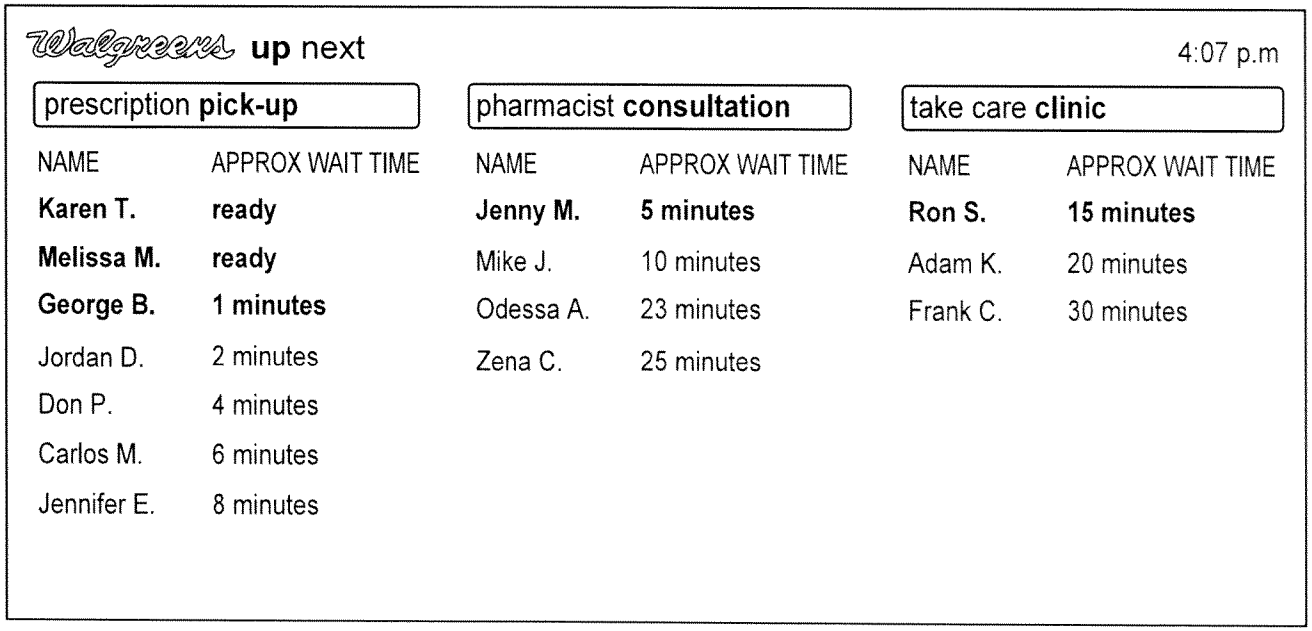
FIG. 9 is a perspective view of a display in the new workspace.
Figure 10:
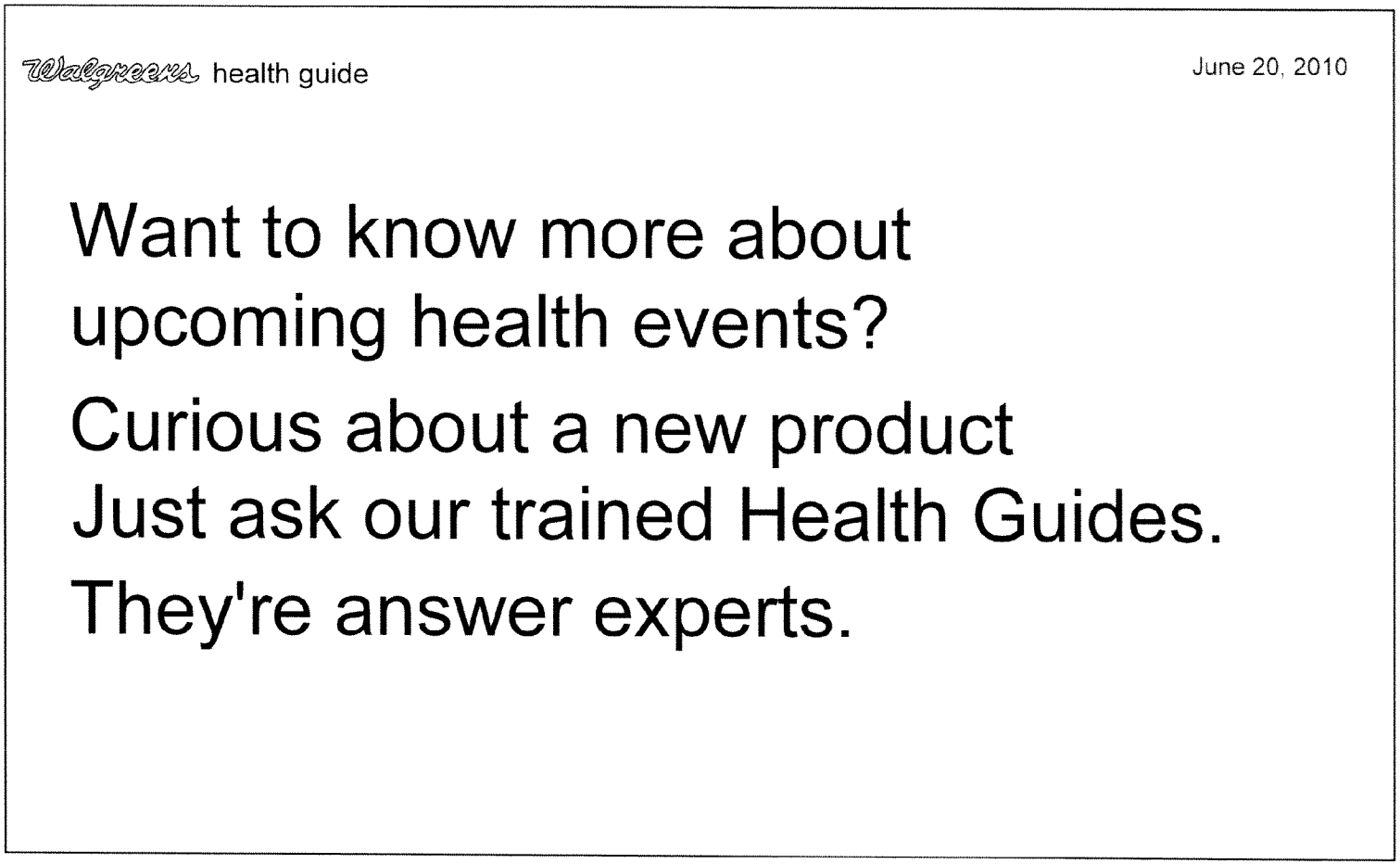
FIGS. 10-12 are examples of screen displays that may be presented on the display seen in FIG. 9.
Figure 11:
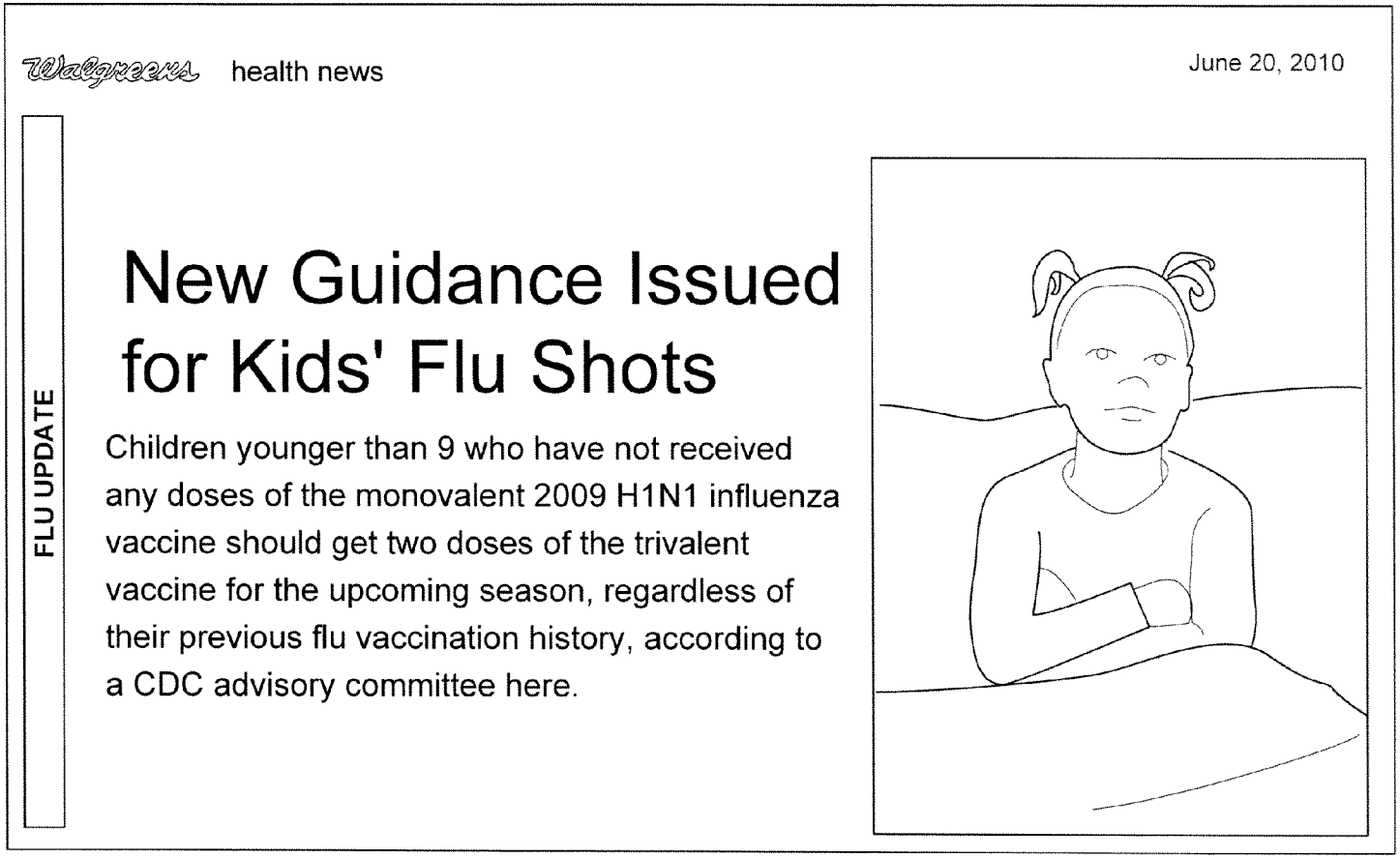
Figure 12:
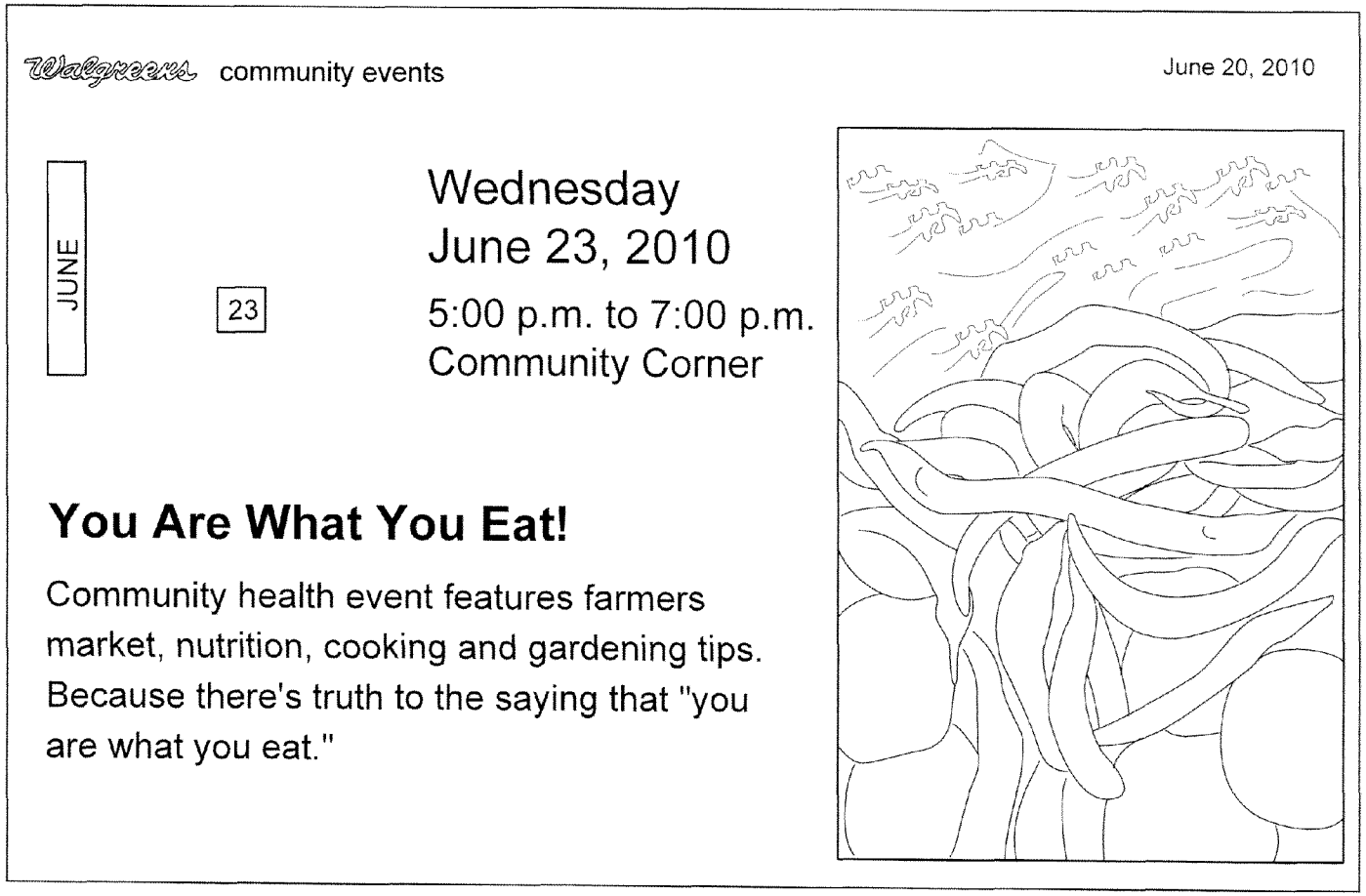

As seen in FIGS. 6 and 7, two fixed kiosks 60 are mounted at the illustrated reception desk 12. These kiosks can be used by customers to check in for services at the clinic station 22 or for community health care events to be conducted at the flexible workspace 24. For example, a welcoming check-in screen such as the one seen in FIG. 8 can enable a customer to choose one of these two types of check-in. Check-in can be accomplished by swiping an identity card or by typing the customer's name or an indentifying number, such as a telephone number. The system can be programmed so that the identification process brings up not just the name of that particular individual, but also the names of other family members who might be accompanying that individual. Upon check-in for services at the clinic station, the kiosk preferably provides the customer with an estimated wait time. Wait times can also be displayed for events conducted at the flexible workspace.

After a customer has checked in, overhead displays 64 (FIG. 1) provide continuously updated information about where the customer falls in the queue for services. In the illustrated arrangement, these displays take the form of three large flat screen displays arranged in a triangular configuration over the reception desk 12. As illustrated in FIGS. 9-12, these displays can provide four types of information, which may be displayed consecutively: wait times for the pharmacy pick-up, for pharmacist consultation, and for service at the clinic (FIG. 9); information about the function of the space (FIG. 10); news stories about health and upcoming events (FIGS. 11 and 12); and information about the employee serving as the health guide. Hanging these displays over the reception desk focuses customers' attention on the desk, helping them to understand the workspace and flow display and giving them confidence that they are in a trustworthy, curated environment.

The health guide is preferably a senior technician who is adept at customer interaction, knows the suite of services available at the store, and has a good knowledge of health issues. It is the role of the health guide to welcome customers, to answer health care questions, and to provide information about health care services and options. Although employing an individual in this role adds labor costs, it is believed to be worth the expense. In addition to fulfilling the preferences of those customers who prefer to obtain their health care information from a live person rather than from an electronic screen, it is believed that employing a health guide may also increase over-the-counter sales and front-end profitability, increase service awareness and enrollment, and position the organization to have longer-term relationships with customers. That in turn may help the organization to retain customers and earn a larger share of their business.

A separate portable touchscreen device, called a health tablet 70 (FIG. 13), can be provided and used by the health guide to enhance consultations with customers by providing personal profiles, medication guidance, suggested healthy goal-setting, and in-depth information about community events, news, and pharmacy programs. If a customer has a specific health care question, then the health guide can use the health tablet to bring up the customer's profile, look up drug interactions, and research products that the customer might wish to consider.

Figure 13:
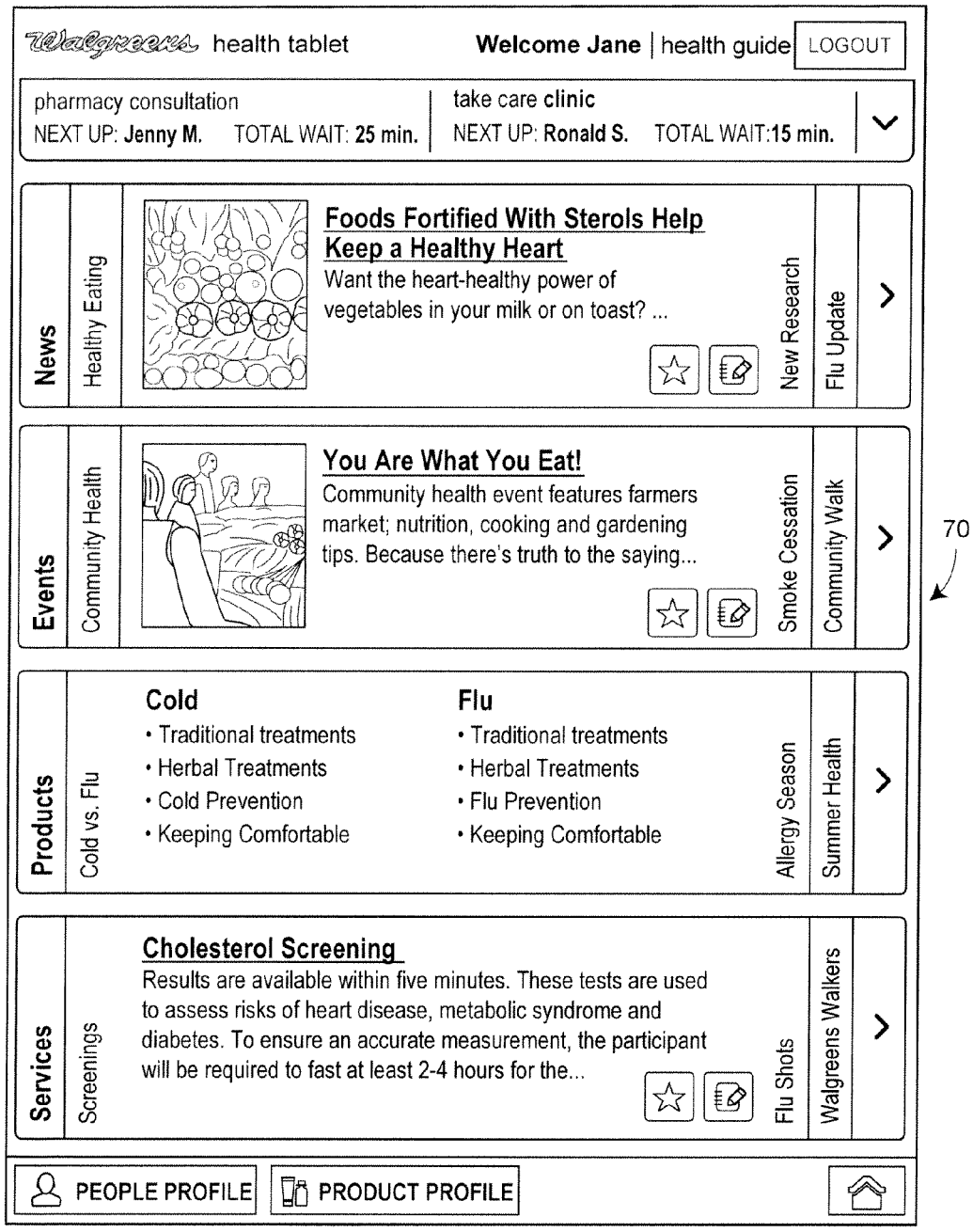
FIG. 13 is a home page screen display on a touchscreen device that can be used in the workspace.

Like the fixed kiosks 60 at the reception desk 12, the health tablet 70 may be programmed with a page that displays various health topics and prompts customers to search for more in-depth information. An example page is seen in FIG. 13, in which exploration options are provided under the topics of "healthy living," "community health," "cold vs. flu," and "screenings."

The health guide can identify the customer in the system in the same ways described above. The system is programmed to use the data associated with the customer in a number of ways.

Figure 14:
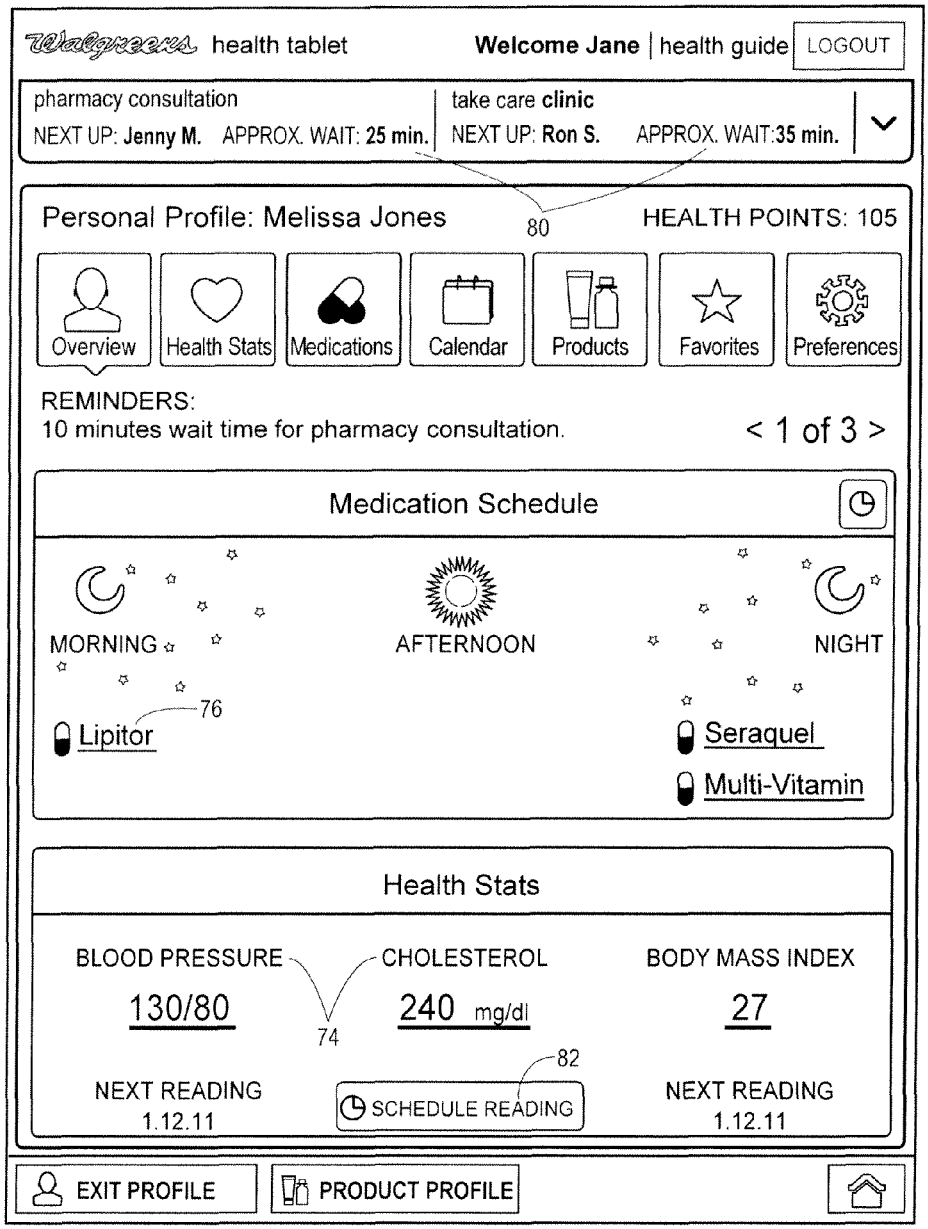
FIG. 14 is an example of a personal profile that can be displayed on the touchscreen device.

First, the system is programmed to bring up a customer's pharmacy information (such as prescription records) on the health tablet 70. As seen in FIG. 14, for example, the health tablet is programmed to display a personal profile for a particular customer that can include health information 74 such as statistics on the customer's last recorded blood pressure, cholesterol, and body mass index, as well as current prescription information 76. The personal profile can also include a history of the customer's medications and product purchases.

The system is also programmed to estimate and display the current wait times 80. This helps the health guide to provide useful information to the customer.

The system is also programmed to use the data associated with the customer to tailor products and services from the store just for that customer. In the illustrated example, the screen includes a prompt 82 for scheduling a new reading or screening. It may also be programmed to automatically prompt or provide the customer with third party health recommendations. These can include, for example, government or health officials' general recommendations about diet or exercise. The system is also programmed to check if the customer's data suggest that the pharmacist may have health recommendations that particularly relate to that customer. Pharmacist recommendations might include, for example, possible recommendation about drug interactions involving medicine that the customer uses. When the data suggest that the pharmacist may have such a recommendation, the tablet prompts or steers the customer to the pharmacist station 18. The system is also programmed to check if the customer's data suggest that the medical assistant may have health recommendations for the customer. These recommendations might include, for example, a possible recommendation about immunizations or screenings. When such possibilities are found, the tablet prompts or steers the customer to the clinic station 22.

Preferably, information on the health tablet 70 is written with limited jargon, in language that can be easily understood by customer. That way, the health guide will feel comfortable showing and discussing the display with the customer, building common trust.

Figure 15:
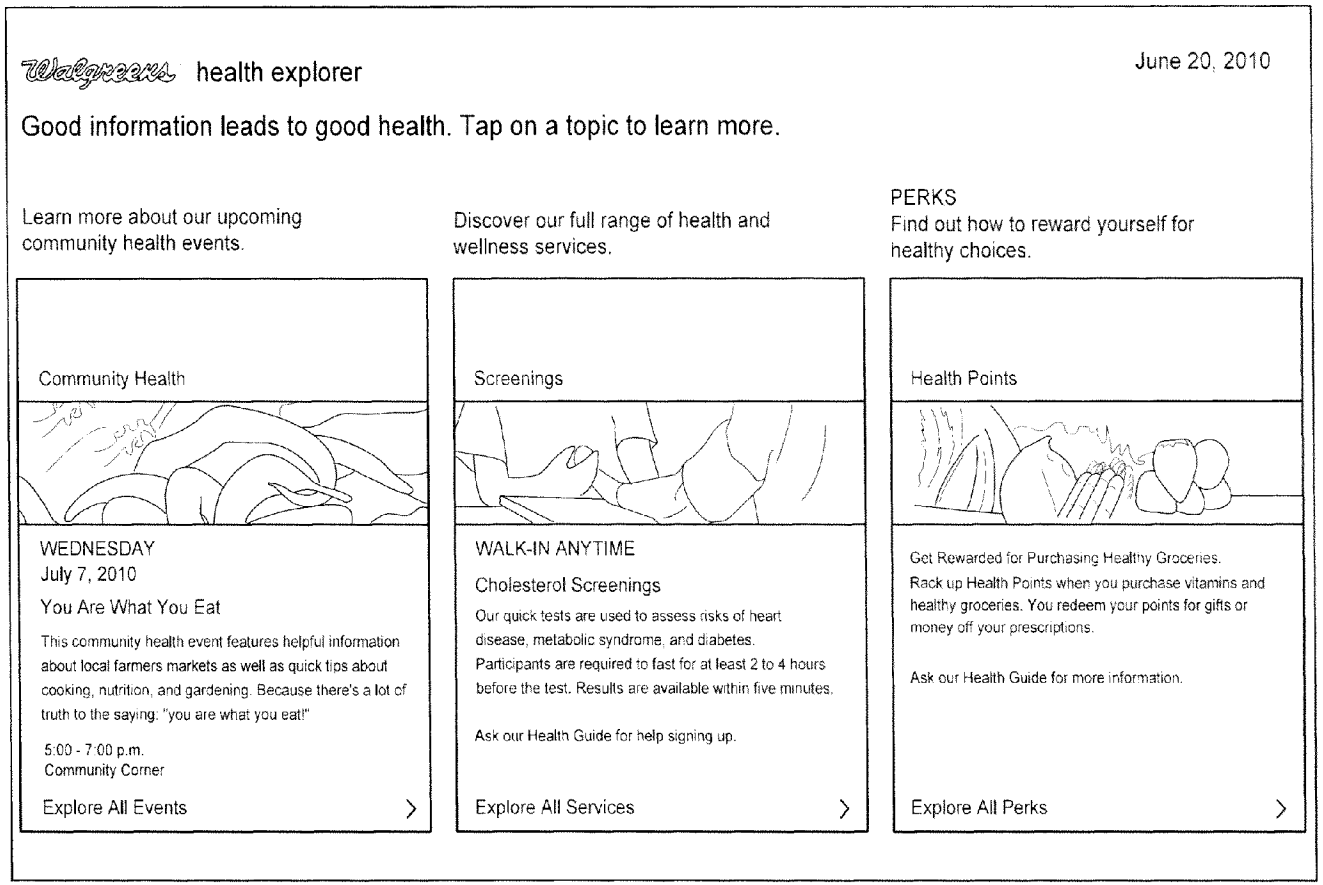
FIG. 15 is another example of a screen display that may be presented on the touchscreen device.

The health tablet 70 can also be used to prompt the health guide to show the customer potential OTC interaction challenges presented by the customer's prescription, or to advise the customer of news or upcoming events that may be of particular interest to the customer. Both the health tablet 70 and the kiosks 60 can be programmed to categorize information in categories such as news, events, products, services, and perks. In the example seen in FIG. 15, the kiosk presents topics under the categories of events, services, and perks. Under a "perks" program, customers are given points for purchasing vitamins and healthy groceries. The points can be redeemed for gifts or money off prescriptions. The account status may be recorded and displayed on the health tablet.

The health tablet 70 can also be programmed with a prompt that enables a customer to sign-up for a meeting with the pharmacist or a medical assistant in the clinic station 22, or for an upcoming community health care event.

The Open Circulation Area

As seen in FIGS. 6 and 7, it is preferred that the reception desk 12 be separated from the prescription station 20, the pharmacist station 18, and the clinic station 22 by only the open circulation area 16. Such an arrangement helps to reinforce the impression of a curated, organized environment, and provides good visibility of the health options that are available to the customer.

Figure 16:
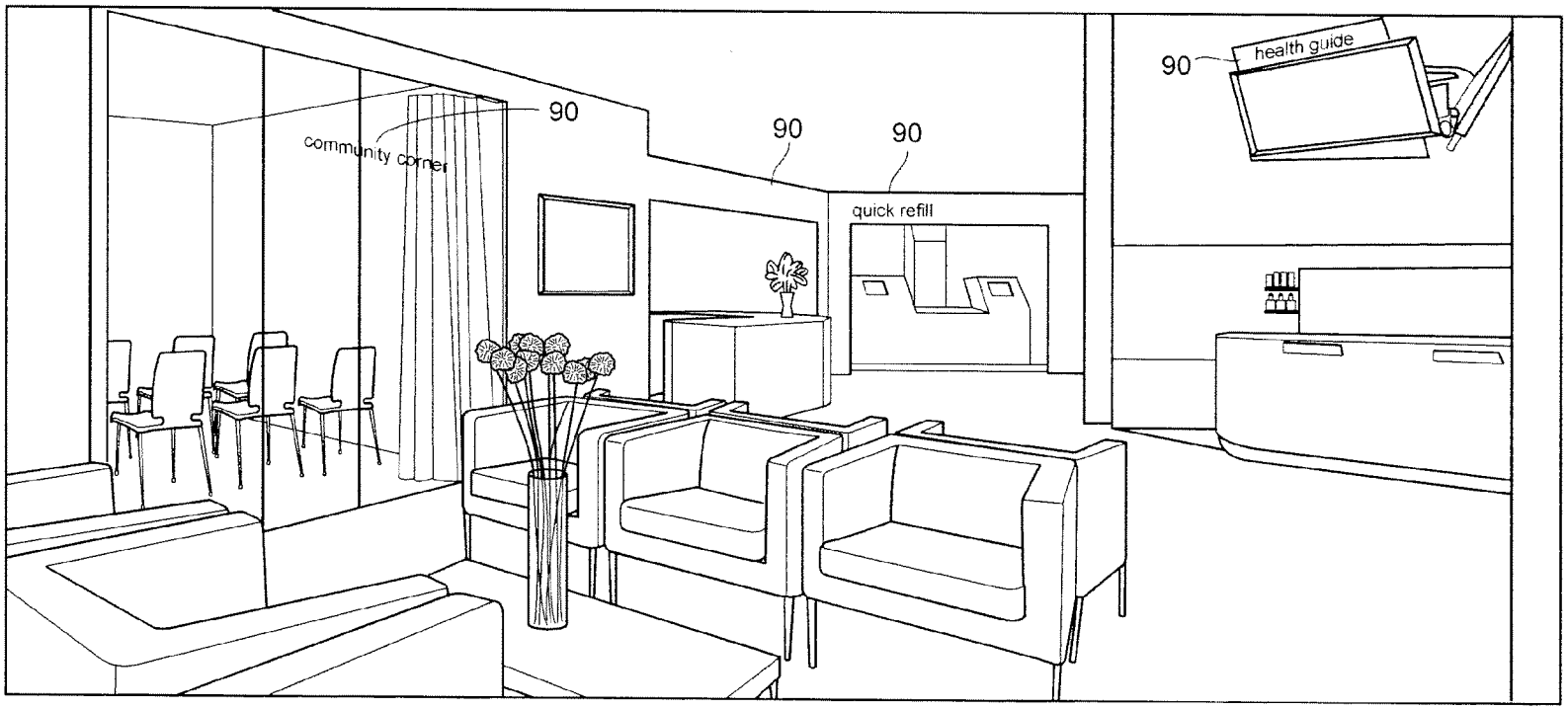
FIGS. 16-18 are customer-level perspective views of parts of the new workspace.
Figure 17:
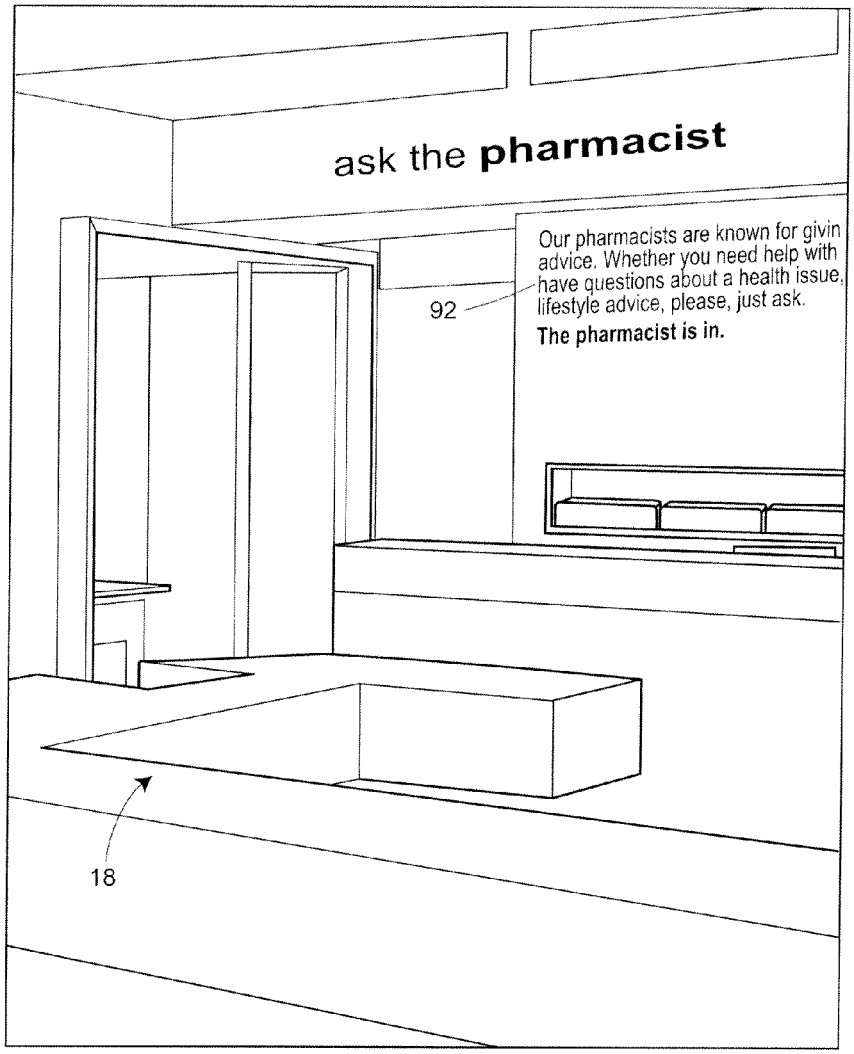

As seen in FIG. 16, each station in the illustrated workspace is marked with coordinating signage 90 that states the purpose of that station. Coordinated signage helps consumers recognize the relationship between the various stations and help to set customer expectations about the services being offered. In addition, large conversational statements may be provided in key areas. For example, the pharmacist station 18 seen in FIG. 17 includes a prominent statement 92 that reinforces a favorable reputation of the pharmacists at the store, helps to build customer trust, and encourages direct contact.

In the workspace seen in FIG. 6, the reception desk 12 is located approximately ten feet from a prescription desk 94 in the prescription station 20 (measuring from the center position within the reception desk to the center of the nearest prescription desk), approximately twelve feet from a the pharmacist desk 98 (measured in a similar way) and approximately sixteen feet from the entrance 100 to the clinic station 22. In this arrangement, the open circulation area 16 is approximately seven feet wide between the reception desk and the nearest prescription desk, approximately eight feet wide between the reception desk and the nearest part of the pharmacist desk, and approximately twelve feet wide between the reception desk and the entrance to the clinic station.

In the arrangement seen in FIG. 7, the reception desk 12 is located approximately twenty feet from the prescription desk 94 (measured the same way as above), approximately fourteen feet from the pharmacist desk 98 (again, measured the same way as above), and approximately twelve feet from the entrance 100 to the clinic station 22. In this arrangement, the open circulation area 16 is approximately twelve feet wide between the reception desk and the nearest prescription desk, approximately eight feet wide between the reception desk and the nearest part of the pharmacist desk, and approximately eight feet wide between the reception desk and the entrance to the clinic station.

The Pharmacist Station

In the new workspace 10, one of the new, alternative ways that a customer can obtain health care information is through one-on-one communications with a pharmacist at the pharmacist station 18. The pharmacist station 18 is preferably staffed by a pharmacist who is hired for his or her ability and desire to work directly with customers. In the arrangement seen in FIG. 6, the pharmacist station is directly behind the reception desk 12, and the pharmacist desk 98 has a front edge that borders and directly faces the open circulation area 16. Pharmacist seating 102 is provided behind the desk. In the arrangement seen in FIG. 7, the pharmacist station is position to the left of the reception desk, and the front edge of the pharmacist desk directly faces not only the open circulation area, but also the reception desk itself. Positioning the pharmacist in a seating position behind a desk that has a font edge that borders the open circulation area enables and encourages the pharmacist to interface directly with customers.

To further enhance the base of knowledge upon which the pharmacist can rely, the illustrated pharmacist station 18 is provided with a health tablet or a kiosk 60 similar to those at the reception desk 12. Preferably, a pharmacist who accesses the tablet or kiosk has access to all the other information available to the health guide. With the pharmacist thus equipped and positioned, customer interactions are expected to lead to deeper customer relationships. This may increase customer loyalty, in particular from chronic patients. Additionally, a relationship-driven approach is expected to increase service sales, front-end trips, and overall lifetime customer value.

Figure 18:
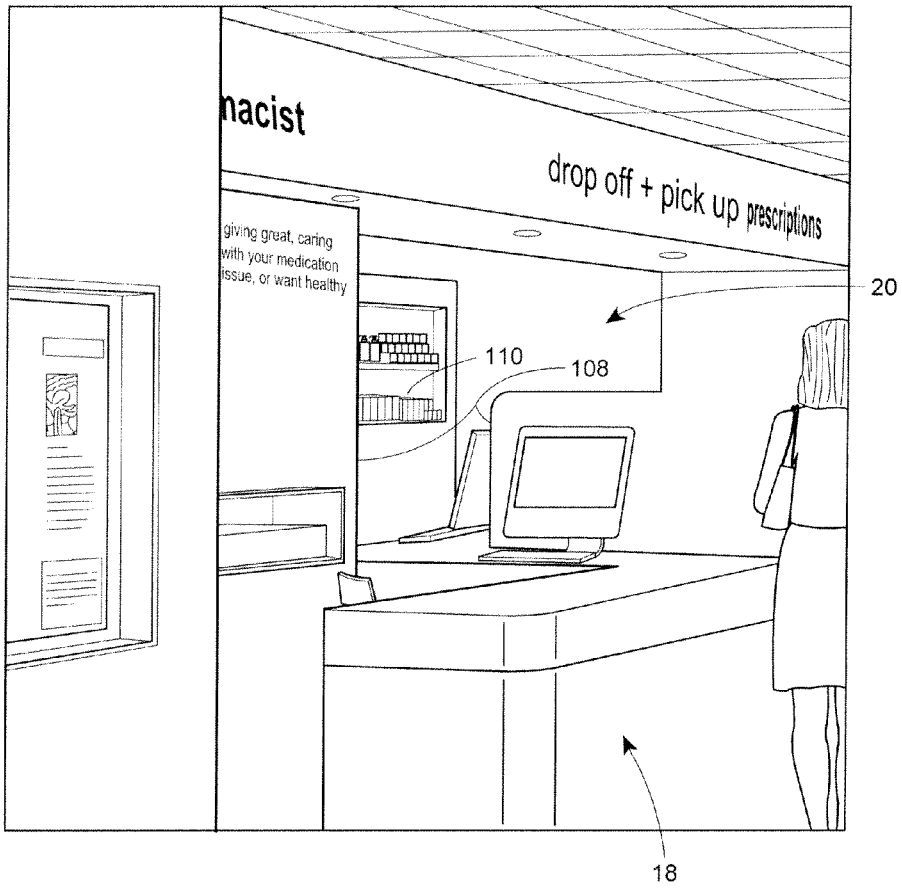

In both of these examples, the pharmacist station 18 is adjacent the prescription station 20, and a pass-through window 108 seen in FIG. 18 enables a pharmacist at the pharmacist station to interact directly with a restricted-access pharmacy area 110 behind the prescription station. This window enables the pharmacist to directly interact with a technician in that restricted-access area, without losing access to customers.

As seen in FIGS. 6 and 7, a private consultation room 114 is arranged across a hallway from the pharmacist desk 98. This room provides a private setting where customers may feel more comfortable in taking discussions beyond medication instruction into life-style challenges and goal setting. The room can also be used as a facility where the pharmacist or a nurse practitioner can provide screenings and immunizations.

The Prescription Station

The prescription station 20 preferably includes two separate desks, a traditional desk 120 where a customer has a traditional person-to-person interaction with a pharmacy technician who takes or fills the customer's prescription, and the desk 94, which is a "rapid refill" desk with kiosks 122 where a customer can identify himself or herself, review his or her prescription and insurance information on-screen, and pay for his or her prescription. To provide good flow, the illustrated desks are adjacent to and angled with respect to each other and face the reception desk 12, giving direct line-of-sight to the display above the reception desk where wait times are displayed.

In both the arrangement seen in FIG. 6 and the arrangement seen in FIG. 7, the traditional desk 120 is approximately 10 feet wide, and is positioned between the rapid refill desk 94 and the pharmacist station 18. The rapid refill desk is approximately 9¼ feet long, and the two desks form an angle of approximately 45 degrees. The two kiosks 122 are positioned at opposite ends of the rapid refill desk and are separated by an open space 126 through which a technician in the restricted-access pharmacy area 110 can interact with a customer.

A customer using one of the kiosks 122 can identify himself or herself in a variety of ways. For example, a customer could identify himself or herself by swiping an identity card, or by entering his or her name or telephone number. FIG. 19 shows one example of an opening screen that could be displayed on the kiosk. As technology continues to advance, identification could be done with little or no deliberate action by the individual, such as by detecting the individual's cell phone signal, or by visual image recognition. Once the individual is identified, the system is programmed to pull up the individual's associated prescription information, and a signal can be sent to a pharmacist technician in the restricted-access pharmacy area 110, who can then begin work on processing the customer's order.

Figure 20:
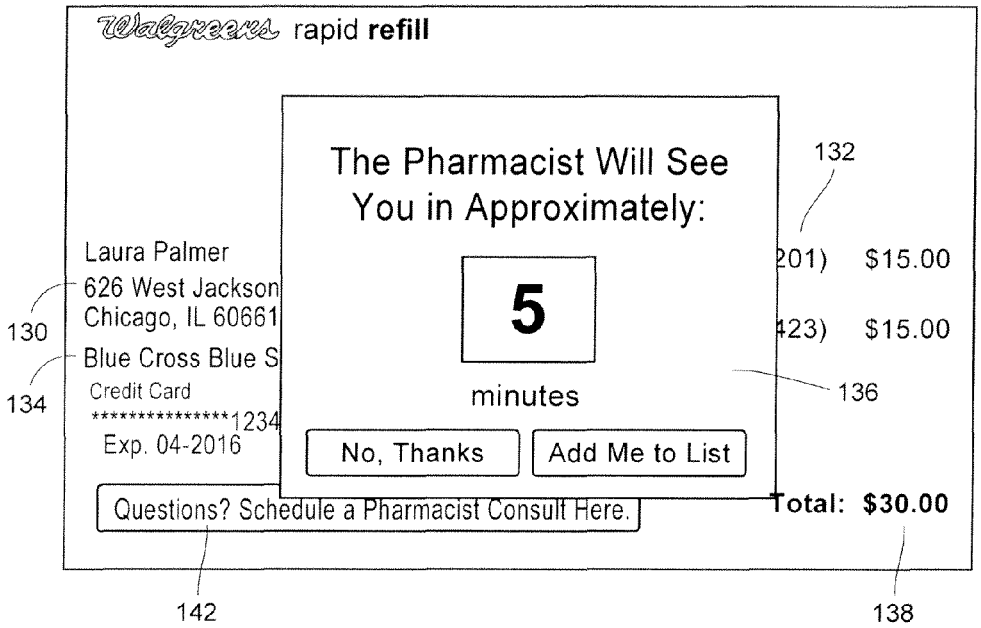
FIG. 20 is an example of another screen display that may be presented on the display seen in FIG. 19.

The check-out process can be completed in as few as three or four clicks on the kiosk screen. After the customer has been identified, the kiosk 122 is programmed to display to the customer a second screen that may confirm the customer's personal information 130, prescription information 132, and insurance information 134; estimate how long it will take to see the pharmacist 136; state the price for filling the order 138; and ask the customer if he or she wants to proceed. Preferably, the screen also provides the customer with an option 142 for scheduling a consultation with the pharmacist at the pharmacist station 18. An example of such a screen is seen in FIG. 20. If the customer wants to proceed, the next screen can provide payment options. A final screen tells the customer where and when the order can be picked up.

Preferably, the kiosk 122 signals to the technician in the restricted-access pharmacy area 110 when the customer has paid for the order. Once the payment is made, the technician hands the filled prescription to the customer, completing the process. It is believed that this semi-automated process minimizes labor expenses and provides added convenience to customers. The added convenience may lead to increased prescription loyalty, further increasing profitability.

Coupling this expedited prescription process with improved customer access to a pharmacist (at the pharmacist station 18) is believed to be particularly valuable.

The Clinic Station

The clinic station 22 provides a walk-in clinic that can be used for common acute issues such as the flu and ear infections. It also serves as a facility where screenings and physicals can be performed. Preferably, patients seeking services at the clinic station 22 check in at the reception desk 12.

The two arrangements of a clinic station 22 seen in FIGS. 6 and 7 each have two side-by-side examination rooms 150 adjoining a waiting area 152 that separates the examination rooms from the entrance 100 to the clinic station. Each examination room provides a private location for physical examinations, and has an examination bed 154 and the conventional equipment provided in such rooms. Each of the illustrated examination rooms occupies an area of between 85 and 125 square feet of space.

Services at the clinic station 22 are preferably supervised or performed by a nurse practitioner or similar medical assistant. In smaller stores, this medical assistant may also serve part-time or full-time as the health guide.

In the illustrated arrangement, the clinic station 22 also features video-conferencing equipment 156 that enables a customer to communicate with an off-site medical specialist.

The illustrated waiting area 152 occupies an area of between 100 and 150 square feet of space. Providing a separate waiting area for the clinic station 22, rather than providing a common waiting area for both the prescription station 20 and the clinic station, increases customer confidence by reducing concerns that waiting to have a prescription filled or to attend a community event might lead to exposure to a communicable disease.

The entrance 100 to the clinic station provides egress between the clinic station 22 and the rest of the workspace 10. Preferably, the entrance adjoins the open circulation area 16 and faces the reception desk 12, again providing direct line-of-sight to the display 64 above the reception desk where wait times are displayed.

The illustrated waiting area 152 is equipped with a medical assistant workstation 160. This workstation enables the medical assistant to accept payment for services and process paperwork for customers being served in the clinic station. A customer can also pay for services performed at the clinic station at an optional traditional check-out register (not shown) at the reception desk 12. Alternatively, for security purposes, customer payment can be handled in other ways. For example, a credit card-only pay station can be provided at the reception desk, or the customer can be referred to the pharmacy station for payment, or the customer can be given a card to be taken to the front of the store for payment at the registers there.

The Flexible Workspace and the Primary Patient Waiting Area

The flexible workspace 24 can be used to host individual or group health and wellness events. These events can be sponsored by the pharmacy or by guest specialists or institutions. For example, personal trainers, specialist doctors, pharmacists, and nurse practitioners could all use this space to host special sessions related to health and health care. The store may choose to charge the host for the use of the workspace (for example, by charging a set fee) or by accepting referral revenue (for example, from fitness center sign-ups), and also can benefit from increased sales to those attending the events.

Alternatively, the flexible workspace 24 can be used for one-on-one coaching or as additional space for crowded activities such as administration of flu shots. Providing more space for such activities can increase throughput and also improve the experience for customers.

It is preferred that the flexible workspace 24 be located adjacent to the primary patient waiting area 26, with the primary patient waiting area positioned between the flexible workspace and the reception desk 12. For effectiveness, it is preferred that both the primary patient waiting area and the flexible workspace each cover at least 120 square feet of floor space. In the arrangement seen in FIG. 6, the primary patient waiting area 26 measures approximately twelve feet by twelve feet, and the flexible workspace measures approximately twelve feet by twelve-and-a-half feet. One side of the primary patient waiting area faces the reception desk, and an opposite side faces the flexible workspace. In the arrangement seen in FIG. 7, the primary patient waiting area measures approximately thirteen-and-a-half feet by twenty feet, and has one side that faces the reception desk and an adjacent, perpendicular side that faces the flexible workspace. The flexible workspace measures approximately fourteen-and-a-half feet by ten feet.

Information about events taking place in the flexible workspace 24 is available at the reception desk 12, and customers can sign up for and check in for those events at that desk.

Figure 21:
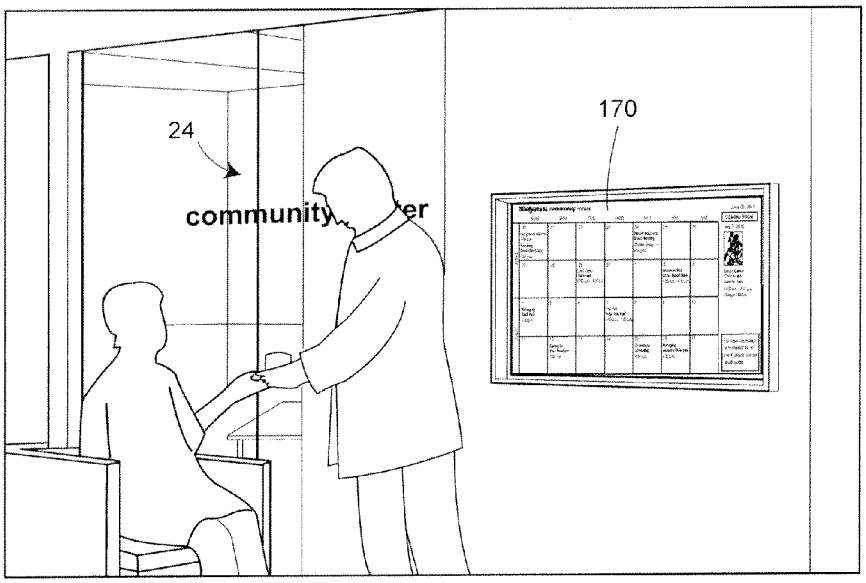
FIG. 21 is a customer-level perspective view of another part of the new pharmacy workspace.

In the arrangement seen in FIG. 21, a community calendar 170 is provided in or adjacent the flexible workspace 24. This calendar is preferably provided on a video screen that coordinates with the displays above the reception desk, and enables customers to view upcoming events. An example display is seen in FIG. 22. Marketing messages can also be included on this display.

Gondolas

Figure 23:
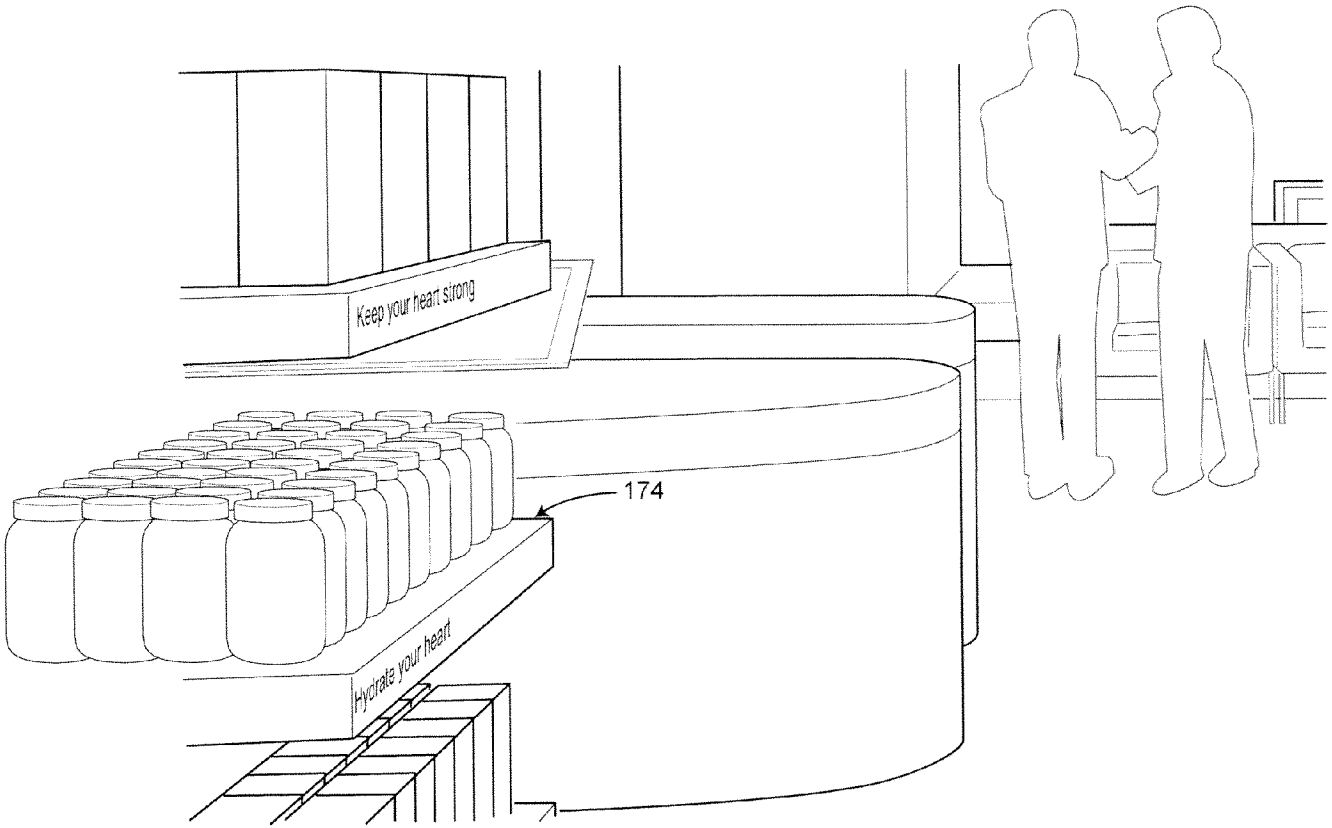
FIG. 23 is a customer-level perspective view of another part of the new workspace.
Figure 24:
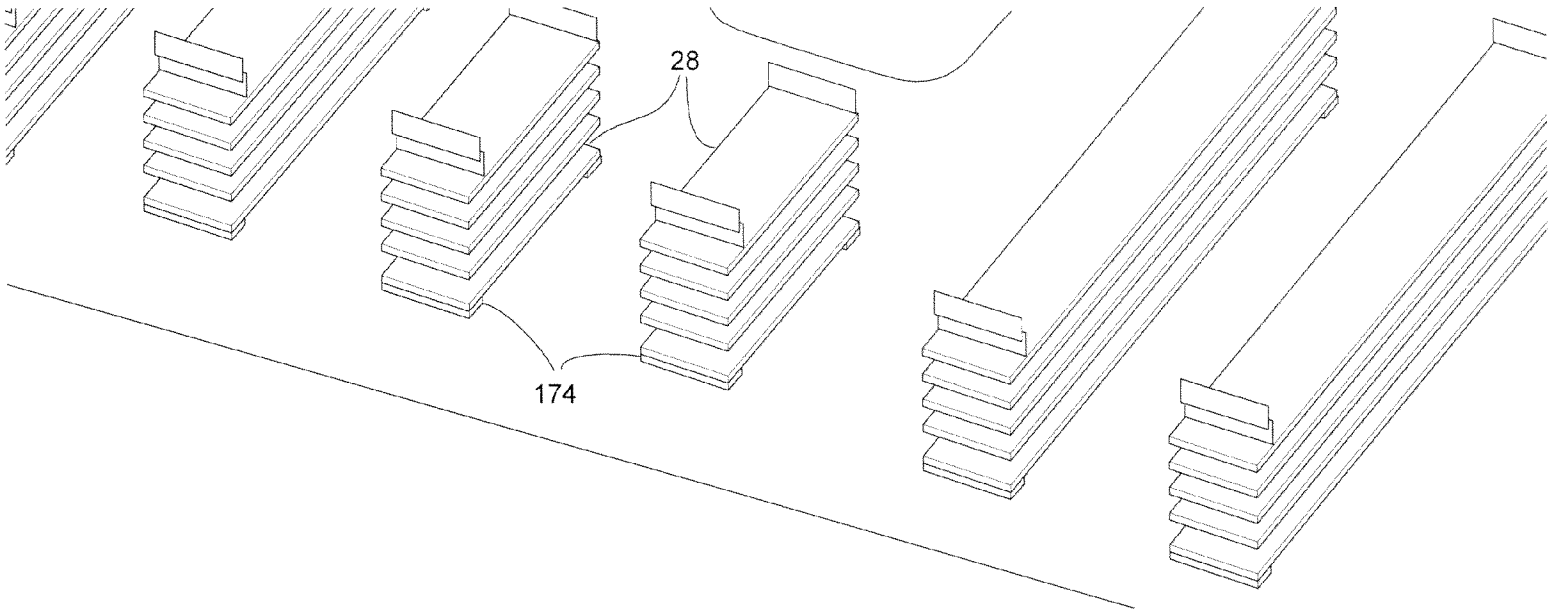
FIG. 24 is a different perspective view of the part of the workspace seen in FIG. 23.

In a preferred embodiment of the invention, the end of each of the gondolas 28 that face the reception desk 12 is provided with an end cap 174 that is a curated by the pharmacy and features products associated with a specific topic, such as cold and flu, seasonal allergies, or heart health. An example is seen in FIGS. 23 and 24. Preferably, the topics are tied to the topics presented on the kiosks 60 and the health tablet. Tying the topics may help foster a sense in the customer's mind that he or she is in a thoughtful, conscientious environment. Building the gondolas nearest to the reception desk with reduced heights (for example, less than 54") provides expanded, open views of the workspace 10, helping the customer to see the layout and thus building his or her confidence in its thoughtful design.

This description of various embodiments of the invention has been provided for illustrative purposes. Revisions or modifications may be apparent to those of ordinary skill in the art without departing from the invention. The full scope of the invention is set forth in the following claims.

The invention claimed is:

1. A pharmacy workspace comprising:

a prescription station where prescriptions are received and where prescription medicine is delivered to a customer;

a prescription desk that is in the prescription station, where customers and pharmacy staff interact;

a pharmacist station that is directly accessible to customers, where customers consult with a pharmacist;

a pharmacist desk that is in the pharmacist station, and is distinct from the prescription desk;

pharmacist seating behind the pharmacist desk;

signage at the pharmacist station that identifies the availability of a pharmacist to consult with customers;

a separate clinic station where common acute health issues are treated, the separate clinic station has an entrance, an examination room, and a waiting area that separates the entrance from the examination room;

signage at the clinic station that identifies the use of the clinic station for treating common acute health issues; and a reception desk that is centrally positioned between the three stations and is separated from the three stations by only an open circulation area, with the entrance to the clinic station facing the reception desk.

2. The pharmacy workspace as recited in claim 1, in which:

the reception desk is located no more than twenty-five feet from the prescription desk and no more than thirty-five feet from the pharmacist desk and from the entrance to the clinic station.

3. The pharmacy workspace as recited in claim 1, in which:

the sum of the distances from the reception desk to (a) the entrance to the clinic station, (b) the pharmacist desk, and (c) the prescription desk is no more than 50 feet.

4. The pharmacy workspace as recited in claim 1, in which:

the prescription desk and the pharmacist desk each have a front edge that borders the open circulation area and faces the reception desk; and the entrance to the clinic station adjoins the open circulation area and faces the reception desk.

5. The pharmacy workspace as recited in claim 1, in which:

the prescription desk borders the open circulation area and faces the reception desk; and the prescription desk has direct line-of-sight to a display above the reception desk where wait times are displayed.

6. The pharmacy workspace as recited in claim 1, in which:

the prescription station has at least one kiosk that prompts customers to enter identifying information and enables customers to confirm and to pay for a prescription.

7. The pharmacy workspace as recited in claim 1, in which:

the pharmacist desk borders the open circulation area and faces the reception desk; and the pharmacist station is adjacent to and connected to the prescription station.

8. The pharmacy workspace as recited in claim 1, in which:

the pharmacist desk has direct line-of-sight to a display above the reception desk where wait times are displayed.

9. The pharmacy workspace as recited in claim 1, in which:

the clinic station has video conference equipment that enables a customer to consult with a health care specialist.

10. The pharmacy workspace as recited in claim 1, in which:

the clinic station has a seating area that has direct line-of-sight to a display above the reception desk where wait times are displayed.

11. The pharmacy workspace as recited in claim 1, in which:

the reception desk has a touchscreen device that (a) enables customers to enter identifying information, (b) prompts users to request information about one or more of health topics, community events, and pharmacy programs, and (c) enables customers to check in for appointments and sign up for events.

12. The pharmacy workspace as recited in claim 1, in which:

the reception desk has a touchscreen device that is programmed to provide third party health recommendations based on data associated with a customer.

13. The pharmacy workspace as recited in claim 1, that also comprises:

a touchscreen device that uses data associated with a customer (a) to automatically provide third party health recommendations for that customer; (b) to steer the customer to the pharmacist station when a pharmacist who is stationed there will have health recommendations for the customer, and (c) to steer the customer to the clinic station when a medical assistant who is stationed there will have health recommendations for the customer.

14. The pharmacy workspace as recited in claim 1, in which:

gondolas proximate to the reception desk are adapted to provide expanded, open views of the workspace.

15. The pharmacy workspace as recited in claim 1, that also comprises:

a meeting room where community health care events are provided by third parties.

16. The pharmacy workspace as recited in claim 1, in which a meeting room where health care events are provided by third parties:

is provided between the clinic station and the pharmacist station;

has direct line-of-sight to a display above the reception desk where wait times are displayed;

is separated from the reception desk by only the open circulation area; and has signage that identifies the use of the meeting room for one or more health care events.

17. A pharmacy workspace comprising:

a prescription station where prescriptions are received and where prescription medicine is delivered to a customer;

a first prescription desk that is in the prescription station, where customers and pharmacy staff interact;

a second customer-facing prescription desk that is in the prescription station and is adjacent to and angled with respect to the first prescription desk;

a pharmacist station that is directly accessible to customers, where customers consult with a pharmacist;

a pharmacist desk that is in the pharmacist station, and is distinct from the prescription desk;

pharmacist seating behind the pharmacist desk;

signage at the pharmacist station that identifies the availability of a pharmacist to consult with customers;

a separate clinic station where common acute health issues are treated, the separate clinic station has an entrance, an examination room, and a waiting area that separates the entrance from the examination room;

signage at the clinic station that identifies the use of the clinic station for treating common acute health issues;

a reception desk that is centrally positioned between the three stations and is separated from the three stations by only an open circulation area, with the entrance to the clinic station facing the reception desk and each prescription desk having a front edge that borders the open circulation area and faces the reception desk.

18. A pharmacy workspace comprising:

a reception desk that is in an open circulation area;

gondolas proximate to the reception desk that are adapted to provide open views of the pharmacy workspace;

a prescription station that is functionally adjacent to the reception desk, is separated from the reception desk by only the open circulation area, and has a pair of adjacent, angled, customer-facing prescription desks that have front edges that border the open circulation area and face the reception desk;

at least one kiosk at the prescription station that prompts customers to enter identifying information and enables customers to confirm and to pay for a prescription;

a pharmacist station that is functionally adjacent to the reception desk, is separated from the reception desk by only the open circulation area, is adjacent to and connected to the prescription station, and has a pharmacist desk that is distinct from the prescription desks, borders the open circulation area, and faces the reception desk;

pharmacist seating that is in the pharmacist station, behind the pharmacist desk;

a clinic station that is located functionally adjacent to the reception desk, has an examination room, and is separated from the reception desk by only the open circulation area;

video conference equipment that is in the clinic station and enables a customer to consult with a health care specialist;

a touchscreen device that uses data associated with a customer (a) to automatically provide third party health recommendations for that customer; (b) to steer the customer to the pharmacist station when a pharmacist who is stationed there will have health recommendations for the customer, and (c) to steer the customer to the clinic station when a medical assistant who is stationed there will have health recommendations for the customer; and a flexible workspace that is provided between the clinic station and the pharmacist station, has direct line-of-sight to a display above the reception desk where wait times are displayed, and is separated from the reception desk by only the open circulation area.

* * * * *